US008113350B2

(12) United States Patent
Sanchez

(10) Patent No.: US 8,113,350 B2
(45) Date of Patent: Feb. 14, 2012

(54) PROTECTION DEVICE FOR A SYSTEM FOR PACKAGING A PRODUCT, SUCH AS A COSMETIC PRODUCT

(75) Inventor: Marcel Sanchez, Aulnay Sous Bois (FR)

(73) Assignee: L'Oreal, Paris (FR)

( * ) Notice: Subject to any disclaimer, the term of this patent is extended or adjusted under 35 U.S.C. 154(b) by 59 days.

(21) Appl. No.: 12/404,870

(22) Filed: Mar. 16, 2009

(65) Prior Publication Data

US 2009/0261007 A1 Oct. 22, 2009

Related U.S. Application Data

(60) Provisional application No. 61/041,068, filed on Mar. 31, 2008.

(30) Foreign Application Priority Data

Mar. 17, 2008 (FR) ..... 08 51722

(51) Int. Cl.
*B65D 69/00* (2006.01)
*B65D 71/00* (2006.01)

(52) U.S. Cl. ..... 206/581; 206/235; 206/1.5; 132/297

(58) Field of Classification Search ..... 206/581, 206/385, 1.5, 248, 249, 252, 560, 540; 312/318; 220/23.89, 23.83, 756, 752, 23.87; 222/470, 222/471, 465.1, 788, 322; 221/230, 272; 132/295

See application file for complete search history.

(56) References Cited

U.S. PATENT DOCUMENTS

| | | | | |
|---|---|---|---|---|
| 2,547,971 | A * | 4/1951 | Polin et al. | 132/297 |
| 3,080,989 | A | 3/1963 | Ramsbotham | |
| 4,562,923 | A * | 1/1986 | Katada et al. | 206/235 |
| 5,082,114 | A * | 1/1992 | Bunin | 206/539 |
| 5,301,808 | A * | 4/1994 | Pierson | 206/581 |
| 6,095,334 | A * | 8/2000 | Belveal et al. | 206/581 |
| 6,336,732 | B1 * | 1/2002 | Shiau | 362/205 |
| 7,621,399 | B2 * | 11/2009 | Nakajo | 206/455 |
| 2006/0285911 | A1 | 12/2006 | Demellier | |
| 2007/0241134 | A1 | 10/2007 | Gurrisi et al. | |
| 2007/0284372 | A1 | 12/2007 | Gnepper | |

FOREIGN PATENT DOCUMENTS

| | | | |
|---|---|---|---|
| DE | 93 03 017 | U1 | 4/1993 |
| EP | 1 059 048 | A1 | 12/2000 |

* cited by examiner

*Primary Examiner* — Mickey Yu
*Assistant Examiner* — Chun Cheung
(74) *Attorney, Agent, or Firm* — Oblon, Spivak, McClelland, Maier & Neustadt, L.L.P.

(57) ABSTRACT

The assembly includes a system for holding a product and a protection device for protecting the system. The protection device includes a cap mounted on the system so as to at least partly cover it and at least one releasing structure for releasing the system. The releasing structure includes a retaining means for retaining the system relative to the cap and an actuating structure for actuating the retaining means in order to disconnect the system and the protection device. The retaining structure is provided on an inner face of the releasing structure, the actuating structure being provided on an outer face of the releasing structure, on the opposite side from the inner face. The releasing structure may be a rocker system and the protection device may cover at least 90% of the packaging system.

18 Claims, 22 Drawing Sheets

20
44
54
50
10
51
S
14
12
16
22

58
20
44
54
10
S
14
12
16
22

PROTECTION DEVICE FOR A SYSTEM FOR PACKAGING A PRODUCT, SUCH AS A COSMETIC PRODUCT

CROSS-REFERENCE TO RELATED APPLICATIONS

This document claims priority to French application number FR 0851722, filed Mar. 17, 2008, and U.S. provisional application No. 61/041,068, filed Mar. 31, 2008, the entire contents of which are hereby incorporated by reference.

BACKGROUND OF THE INVENTION

1. Field of the Invention

The present invention relates to the field of protection devices for product containers. One described useful application is in the protection of a container that contains a cosmetic product. The term "cosmetic product" is intended to mean a product as defined in Council Directive 93/35/EEC of 14 Jun. 1993. One example of the invention relates in general to a device designed to be fitted onto a product container so as to at least partly cover it.

2. Description of the Related Art

In the cosmetic field, document US-A1-2006/0285911 describes a cap for blocking or closing off a device for packaging a lipstick provided with a sleeve inside, which the device is intended to be housed and on which ramps are made that cooperate with a lug provided on a ring surrounding the sleeve. A resilient spring is also provided between the bottom of the cap and the packaging device so as to make it easier to extract it from the cap. A closure cap for a lipstick packaging device is also disclosed in document GB 834,486.

The closure caps of these documents have in particular the major drawback of comprising a relatively large number of parts in order to protect the packaging devices and to extract them from the cap.

Described by document FR-A2-2 617 132, is a container having a maneuverable cap held in a closure position on the container via a peripheral ring provided with means for moving the cap relative to the container.

This structure has a relatively complex design, thereby increasing its manufacturing cost.

Described by document DE-A1-3426351, is a portable container intended to house a plurality of cosmetic sticks and comprising a body for accommodating the sticks, in which retaining means mounted so as to slide inside the body are provided, in order to be able to be moved between a stick storage position inside the body and a use position in which the sticks project therefrom. This container has in particular the drawback of being very bulky and of complex design.

In another technical field, U.S. Pat. No. 6,612,450 describes a cap for a product storage container, which includes a tongue on which hooks for retaining the cap on the container are provided. The tongue is pivotable, so that the cap can be disconnected from the container. A similar cap is also described in U.S. Pat. No. 5,449,077.

These caps may not provide good sealing of the product contained in the container. This is because, owing to the design of the tongue or tongues, there are passages that may allow the ingress of air or polluting agents into the container that contains the product, thereby possibly modifying the physico-chemical properties of the product.

SUMMARY OF THE INVENTION

One object of the present invention is therefore to remedy some of the drawbacks of one or more of the above-noted conventional designs.

One aim of the present disclosure is to provide a protection device for a product packaging system that achieves good sealing, especially with regard to the solvents that may be used in the product and/or the ambient air liable to come into contact with the product.

Another aim is to provide a device that is easy to manufacture, is inexpensive and able to be transported easily with reduced risk of the device becoming detached from the system.

Another aim is to provide a device that can be easily handled and enables the device to be rapidly disconnected from the system.

Another aim is to provide a device with improved handleability, while reducing the risk of the system being spontaneously released.

Another aim is to provide a compact device.

Another aim is to provide a protection device that is particularly suitable for a system containing a cosmetic composition.

An example of the invention according to a first aspect is an assembly comprising a system for packaging a cosmetic product and a protection device for protecting the system. The protection device comprises a cap mounted on the system so as to at least partly cover it and at least one releasing means for releasing the system. The releasing means comprises a retaining means, for retaining the system relative to the cap, and an actuating means for actuating the retaining means in order to disconnect the system and the protection device. The retaining means is provided on an inner face of the releasing means, the actuating means being provided on an outer face of the releasing means, on the opposite side from the inner face. This releasing means is of the rocker system type. The protection device typically covers at least 90% of the packaging system.

Advantageously, the cap is configured so that a free end edge is flush with an end wall of the packaging system in the covering position.

In one embodiment, the packaging system comprises an actuating means for dispensing the product, the retaining means cooperating with a groove made in the actuating means.

Preferably, the cap includes means for positioning and blocking the protection device on the packaging system.

The retaining means and the actuating means may thus respectively define a retaining surface and an actuating surface, these being respectively provided on an inner face and an outer face, opposite the inner face, of the releasing means. This retaining means and this actuating means may thus extend on either side of the same wall, that is to say a common wall. Considering an axis of elongation of the releasing means and/or of the cap, these means may be provided with axial heights that differ from one another. As a variant or additionally, these means may be provided so as to be radially offset one with respect to the other.

In one example, the retaining means is made as one piece with the actuating means.

The releasing means may be attached to the cap. Thus, this releasing means may be fixedly anchored to this cap. However, this releasing means may be able to move angularly relative to the cap. To do this, the means may be fastened to the cap, for example by one or more bridges of material produced as one piece with the cap or by the use of pins attached to the cap, especially rotation or pivot pins.

In relation to an axis of extension of the cap, the releasing means may extend to an intermediate axial height of the cap. In other words, this releasing means may extend to a certain distance from a lower end surface of the cap and to a certain distance from an upper end surface of the cap.

Preferably, the device includes a base for accommodating a container of the system, the base being able to be at least partly fitted inside the cap so as to define a closed chamber for the container. Advantageously, the retaining means comprises snap-fastening means that cooperate with the system or with the accommodating base of the container. The snap-fastening means may include at least one hook that cooperates with a groove made in the system or in the base. This groove may have any other appropriate shape, especially a linear or curved profile cross section. In particular, the groove may have a circular cross section relative to an axis of extension of the device. Preferably, the groove is annular. This arrangement may avoid providing an indexing means between the cap and the container. These snap-fastening means may also comprise a plurality of recesses radially and/or axially spaced apart from one another.

Advantageously, the protection device includes covering means attached to the cap in order to at least partly cover the releasing means.

In one embodiment, covering means may partially, or even completely, cover the releasing means and in particular the outer face of the releasing means. In one example, these covering means may engage with at least part of the releasing means and also optionally with at least one part of the cap.

In one embodiment, the covering means leave the actuating means at least partly free so as to be accessible from the outside. The actuating means may comprise a lug at least partly extending into a housing made on the covering means.

The actuating means may be at least partly flush with the covering means.

In one embodiment, the covering means extend at least partly into an opening made in the cap. Advantageously, the covering means may be flush with an outer surface of the cap.

In another embodiment, the covering means comprise an envelope mounted around the body.

The covering means may be made of a different material from that of the body, for example a more flexible one. The covering means may be made of a thermoplastic or an elastomer, for example. The body may be made of a thermoplastic, especially a polyolefin, or a metallic material, for example.

Preferably, the releasing means comprises a rocker system. More precisely, this system comprises at least one rotation or pivot pin. This pin may be located between the retaining means and the actuating means, both the means being located axially on either side of the pin. In other words, considering an axis of elongation of the cap or of the releasing means, at least one rotation pin may extend to an intermediate axial height between the retaining means and the actuating means.

The device may also include at least one return means capable of making it easier to disconnect the system and the protection device when the actuating means is stressed. The return means or a plurality of the means are advantageously formed by the cap. In other words, the one or more return means are made of one piece with the cap, and especially molded with the cap.

In one embodiment, the releasing means is made as one piece with the body. As a variant, the means is attached to the body.

In one embodiment, the device comprises a single releasing means. As a variant, the device comprises two diametrically opposed releasing means.

The invention also relates, according to a second aspect, to a protection device for a product container, the device comprising a cap intended to be mounted on the container so as to at least partly cover it, and at least one container releasing means placed on the cap. The releasing means comprises a means for retaining the system relative to the cap and a means for actuating the retaining means in order to disconnect the system and the protection device. This releasing means is preferably of a rocker system type. The device further includes covering means attached to the cap in order to at least partly cover the releasing means.

One example of the invention also relates, according to a third aspect, to a device for protecting a product container, the device comprising a cap configured to be mounted on the container so as to at least partly cover it and at least one container releasing means placed on the cap. The releasing means comprises a means for retaining the cap relative to the container and a means for actuating the retaining means in order to disconnect the container relative to the protection device. The retaining means is provided on an inner face of the releasing means. The actuating means is provided on an outer face of the releasing means, opposite the inner face.

According to a general feature, the device further includes covering means attached to the body in order to at least partly cover the releasing means.

The packaging system may include a product applicator. In one example, only the applicator is disconnected from the protection device when the releasing means is activated.

One aspect of the invention provides an assembly including a package system configured to hold a product and a protection device that protects the package system. The protection device includes a cap mounted on the package system so as to at least partly cover the package system. The protection device includes at least one release that releases the cap from the package system, the release including a protrusion that connects the package system to the cap, and an actuator that moves the protrusion relative to the package system, the protrusion being provided on an inner face of the release, the actuator being provided on an outer face of the release, on the opposite side from the inner face, the release being configured to pivot about an axis. In one example the protection device covers at least 90% of the package system.

BRIEF DESCRIPTION OF THE DRAWINGS

Examples of the present invention will be more clearly understood upon reading the detailed description of entirely non-limiting exemplary embodiments illustrated by the appended drawings, in which.

DETAILED DESCRIPTION OF THE PREFERRED EMBODIMENTS

Figure 1:
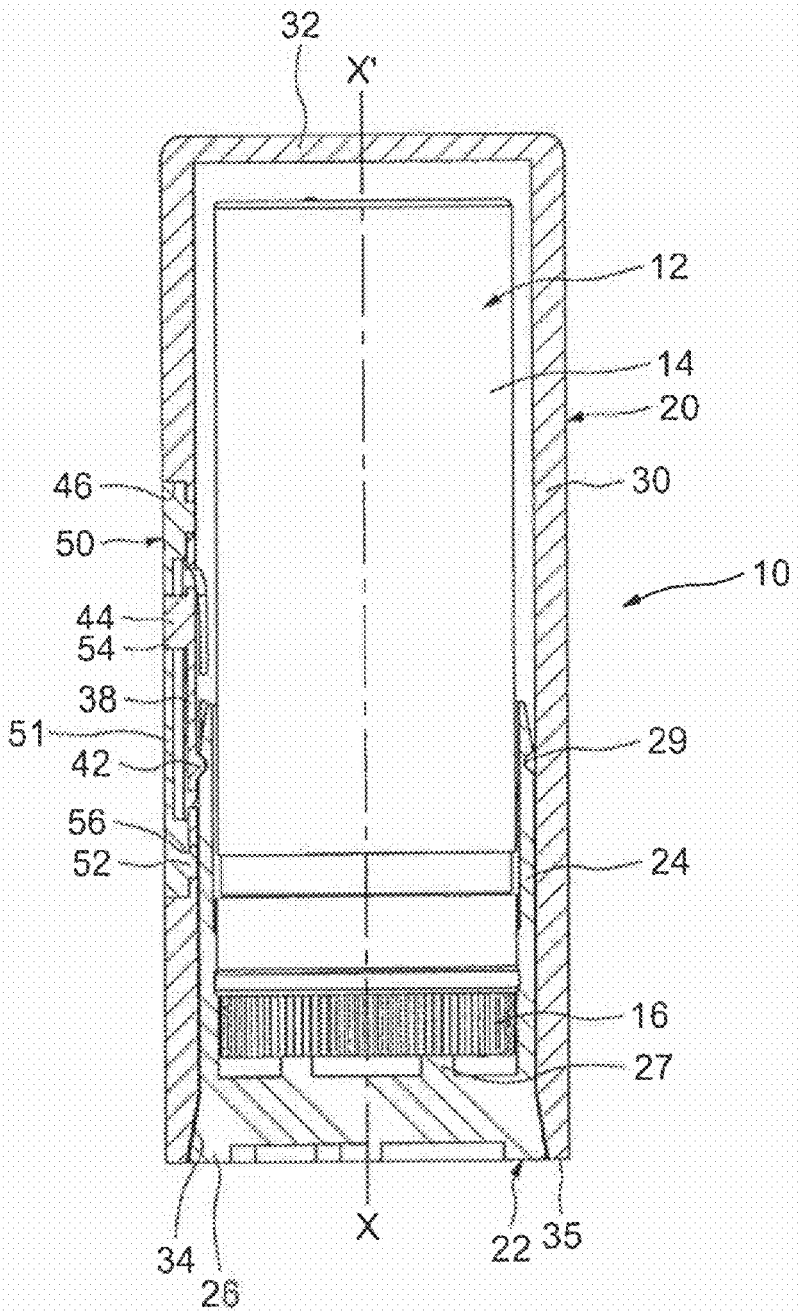
FIG. 1 is a sectional view of a protection device for a product packaging/dispensing system according to a first embodiment.

Referring now to the drawings, like reference numerals are utilized to designate identical or corresponding parts throughout the several views.

Figure 2:
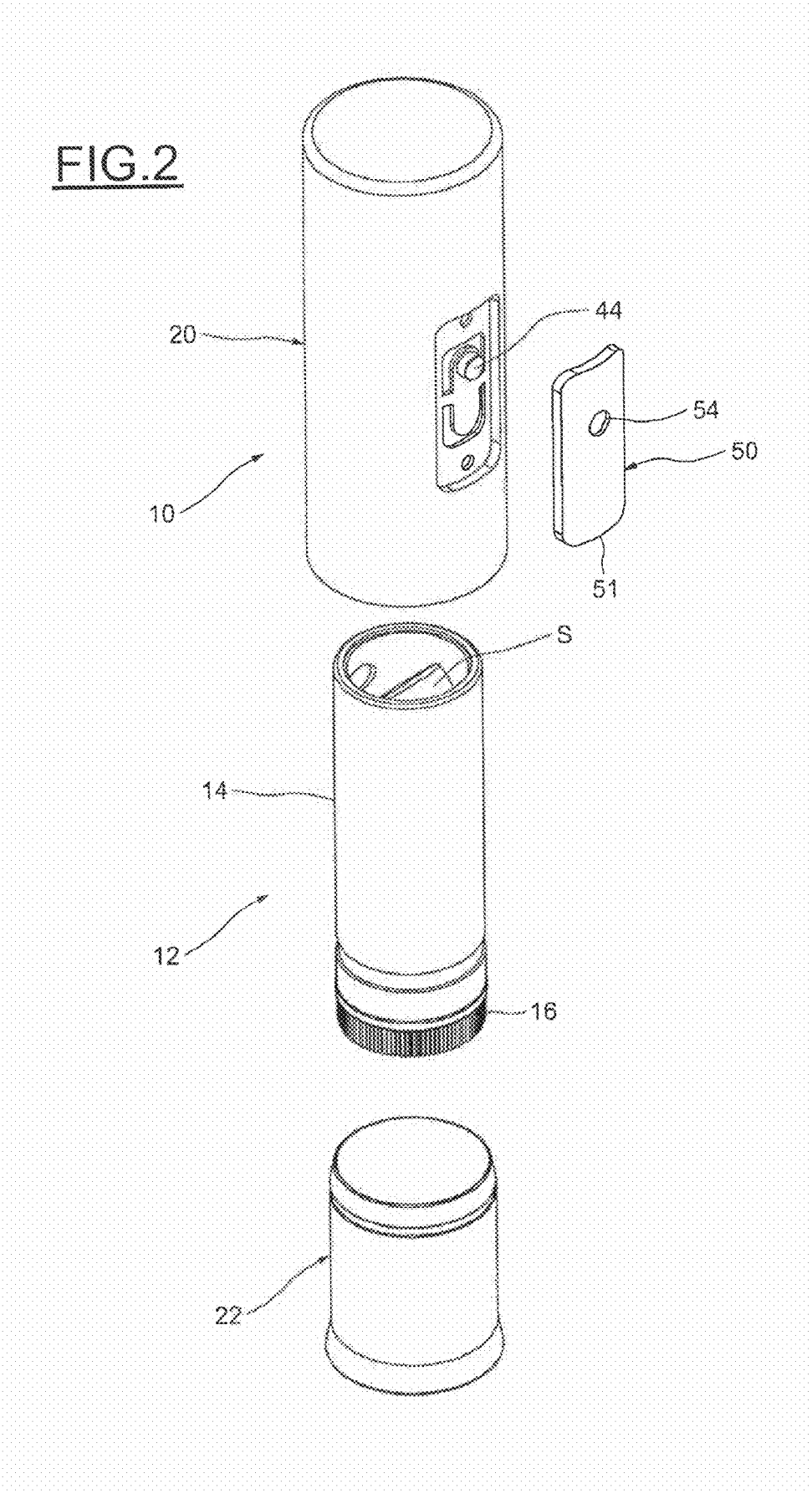
FIG. 2 is an exploded perspective view of the device of FIG. 1.

FIGS. 1 and 2 show a device, denoted by the general numerical reference 10. The device is configured to be used to at least partly protect a system 12 for packaging a product. In one example, the product is a cosmetic product. The device 10 is shown in these figures in an assumed vertical position.

In the example in question, the packaging system 12 may also dispense a stick S or block of a product, especially a cosmetic product. The stick S may for example be a lipstick, a lip care product, a foundation, an eye shadow, a rouge, a color corrector, a treating or moisturizing composition, a deodorant or a hair care product.

As a variant, the protection device 10 may of course be used to protect other types of packaging systems 12 and/or other types of product. The device 10 may for example be associated with a perfume bottle, with a bottle for nail varnish, mascara or gloss, or alternatively with a pot of care cream, a make-up case for rouge, for eye shadow, etc. The cross section of the device 10 may be defined according to that of the object to be protected—for example the cross section may be circular, elliptical or polygonal, such as square, rectangular, hexagonal, octagonal, etc.

As will be described in detail later, the device 10 may be especially suitable for properly protecting the product contained so as to limit any ingress of air that might modify the physio-chemical properties of the product.

The packaging system 12 typically comprises in particular a drive mechanism 14, in order to allow the stick S to pass from a storage position to a use position, and an operating member 16 mounted at one of the mechanism so as to cause displacement of the stick S. Here, the operating member 16 has striations over its entire outer surface. The drive mechanism 14 comprises an outer envelope or sleeve, a guiding sheath mounted in the envelope, and a cup for supporting the stick S, the cup being mounted so as to slide inside the sheath. The operating member 16 is typically fastened to the envelope and designed to be rotated with the envelope. The envelope and the sheath conventionally include grooves so as to allow the support cup to undergo axial displacement during rotation of the operating member 16.

In the depicted example, the protection device 10 comprises a protective cap 20 intended to at least partly cover the packaging system 12 and a base 22 for supporting the system. The protective cap 20 and the base 22 define here a chamber inside which the system 12 is entirely housed.

The support base 22 comprises a body 24 of substantially annular general shape and provided with a radial bottom wall 26 having a radial dimension slightly greater than that of the body 24 and flaring outwards so as to form an outer frustoconical surface. The body 24 extends along a vertical axe X-X' forming the longitudinal axis of the protection device 10.

Figure 3:
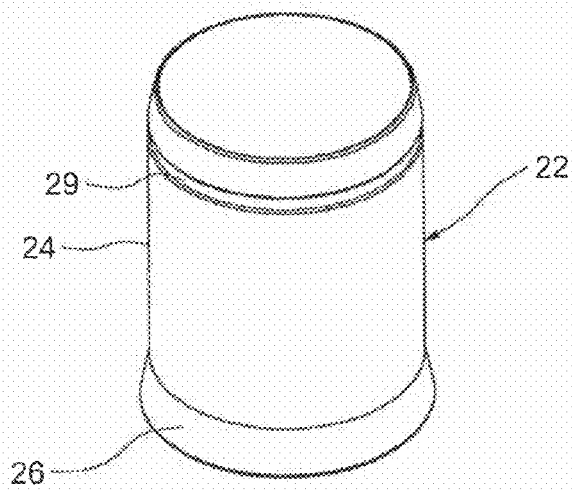
FIGS. 3 and 4 are perspective and sectional views, respectively, of a base of the device of FIG. 1.
Figure 4:
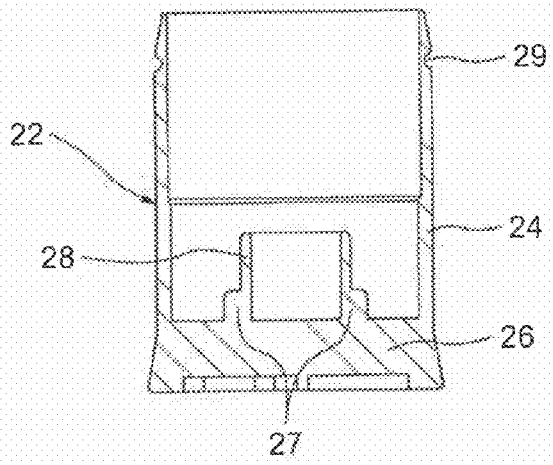

As illustrated in FIGS. 3 and 4, the support base 22 also includes an annular stud 28 extending from the bottom wall 26 towards the upper free end of the body 24. The stud 28 has an axial dimension substantially smaller than that of the body 24. The body 24, the bottom wall 26 and the stud 28 serve to mount the operating member 16 and part of the drive mechanism 14 inside the base 22.

In order to drive the operating member 16 when the support base 22 is rotated, the base also includes radial lugs 27 joining the stud 28 and arranged to cooperate with corresponding housings made on the operating member 16. In the depicted example, there are four lugs 27 uniformly distributed around the circumference of the stud 28. The support base 22 also includes an annular groove 29 made on the outer surface of the body 24, near its upper free end, as will be described in greater detail later. Advantageously, the support base 22 may be made as a single part by molding a thermoplastic, for example polypropylene (PP).

Again referring to FIGS. 1 and 2, the protective cap 20 has an annular body 30, of axis X-X', closed off at an upper axial end by a radial wall 32 and having, at the opposite axial end, an internal surface 34 matching the shape of and in contact with the outer frustoconical surface of the radial wall 26 of the support base 22. The body 24 of the base is housed inside the body 30 and comes into radial contact with the latter. It typically extends substantially up to mid-height of the body 30. A large-diameter edge of the internal surface 34 may be extended radially outwards by a transverse end surface 35 or free edge of the body 30.

The protective cap 20 is shaped so that the transverse end surface 35 is flush with the lower end of the radial wall 26 of the support base 22. The support base 22 in this example is therefore entirely housed inside the protective cap 20, and the protective cap 20 entirely covers the packaging system 12. In this position, neither the support base 22 nor the packaging system 12 can therefore be directly handled by the user.

Figure 5:
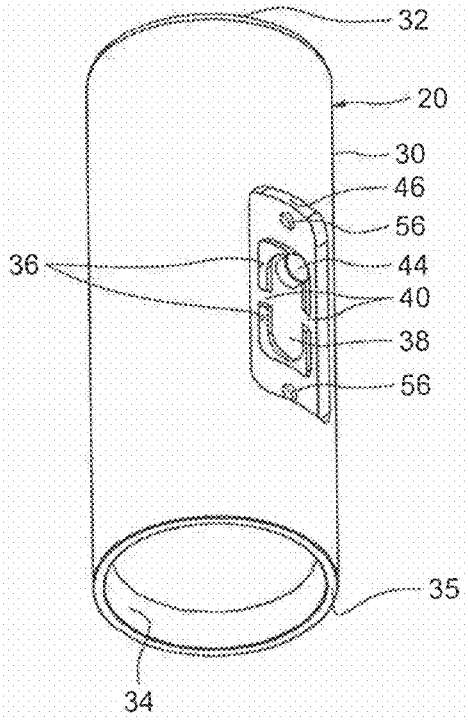
FIGS. 5 and 6 are perspective and sectional views, respectively, of a cap of the device of FIG. 1.
Figure 6:
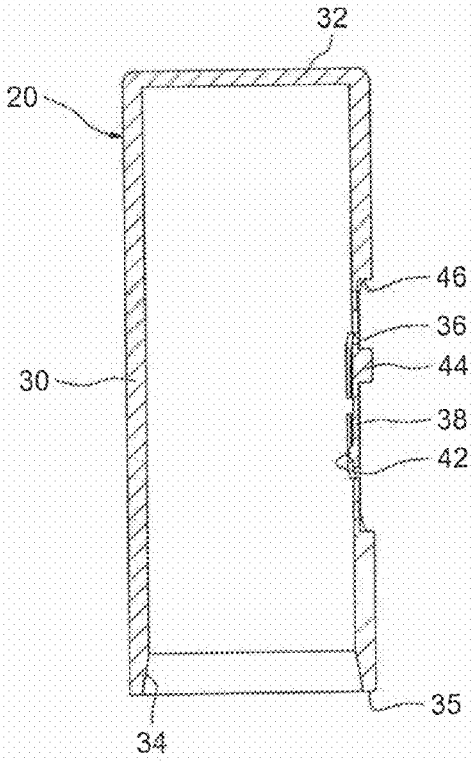
Figure 7:
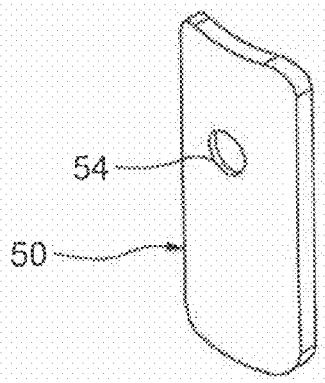
FIGS. 7 and 8 are perspective views of covering means for covering the cap of FIGS. 5 and 6.
Figure 8:
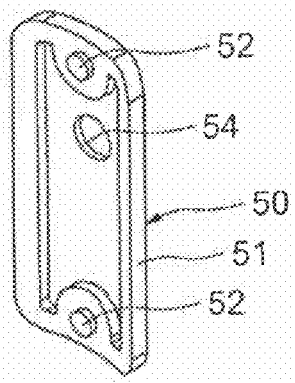

As illustrated in FIGS. 5 and 6, the protective cap 20 includes, provided on the body 30, two axially facing generally C-shaped notches 36. The notches 36 define a tongue 38 connected to the body via two circumferentially opposed bridges of material or hinges 40. The hinges 40 form a pivot pin for the tongue 38.

The tongue 38 has, on the inside, a radial protrusion, for example, hook 42, extending towards the inside and arranged to cooperate with the annular groove 29 of the support base 22 so as to retain the base and the packaging system 12 inside the protective cap 20. The hook 42, located on the inner face of the tongue 38, typically has a smaller diameter than that of the body 24 of the base 22 so that there is diametral interference between these two parts, at the hook 42 and the groove 29. The hook 42 thus forms a means for axially retaining the support base 22 and the packaging system 12 relative to the protective cap 20 so as to form a unitary assembly. In other words, the hook 42 in this example forms snap-fastening means for snap-fastening the protective cap 20 onto the support base 22. The hook 42 is located axially on a portion of the tongue 38 located beneath the hinges 40. In the embodiment illustrated, the protective cap 20 has a single hook. As a variant, it is possible to provide a larger number of hooks.

Through the cooperation of the frustoconical surface 34 of the cap 20 with the radial wall 26 of the base 22, it is possible to achieve correct relative axial positioning of the base and the cap 20. The hook 42 can thus be positioned radially opposite the groove 29. Furthermore, this cooperation also improves the ability of the two elements to be kept in position by friction.

To enable the protective cap 20 to be disconnected from the base 22 inside which the packaging system 12 is housed, the tongue 38 also typically includes, on the outside, a radial lug 44 forming a means for actuating the hook 42. The lug 44 is provided on the outer surface of the tongue 38 and extends radially outwards. It is located axially on the opposite side from the hook 42 in relation to the hinges 40. Here, the lug 44 has a cylindrical general shape. Of course, other examples provide a lug of substantially different general shape, for example one having a rotationally symmetrical, for example polygonal, cross-section.

As indicated above, in this example, the hinges 40 form a pivot pin for the tongue 38. The lug 44 and the hook 42 are located axially on either side of this pivot pin. Consequently, when a user presses on the lug 44, exerting a force directed towards the inside of the cap 20, the tongue 38 undergoes a pivoting movement, which has the effect of moving the hook 42 away, towards the outside, and of releasing the support base 22 having the packaging system 12. The base 22 can then slide under gravity so as to allow the user to grip it for the purpose of using the system 12. The inner face of the tongue 38 having the hook 42 therefore forms a surface for retaining the support base 22 and the system 12, the opposite outer face provided with the lug 44 having an actuating surface for moving the hook 42.

In other words, the hook 42, for axially retaining the support base 22 and the system 12, and the lug 44, enabling the hook 42 to be disengaged from the groove 29, form a releasing means for releasing the support base 22 and the system 12 relative to the protective cap 20. The hook 42, the lug 44, the tongue 38, the hinges 40 and the body 30 are made as one piece. Advantageously, the protective cap 20 is made of a single part by molding a thermoplastic, for example a polyolefin (PO). As a variant, the protective cap 20 may be made of a metallic material, such as steel, for example from a thin sheet rolled up and bonded so as to form a cylinder.

The notches 36 defining the tongue 38 are provided in the thickness of the body 30 so that the lug 44 is approximately flush with the outer surface of the body 30. A blind indentation or recess 36 is provided on the body 30 around the notches 36. The recess 46 may for example be of polygonal general shape, such as a rectangular or square shape, or else it may be elliptical or circular for example. In this example, the recess 46 extends axially over the body 30 over a height approximately equal to half that of the body. The recess 46 is bounded circumferentially by opposed lateral edges located close to the hinges 40. These lateral edges define the long sides of the recess 46 in the depicted embodiment.

To limit the ingress of air or contaminants inside the protective cap 20, the device 10 includes a cover or covering means 50 for covering the notches 36, the hinges 40 and the tongue 38 from which the hook 42 and the lug 44 stem. The covering means 50 has a body 51 that matches the shape of the recess 46 and is housed inside the latter.

To enable the covering means 50 to be retained on the body 30, studs 52, two in number in the depicted example, are provided on the body 51, and corresponding fastening holes 56 are formed in the bottom of the recess 46. The thickness of the body 51 is chosen so as to be flush with the cylindrical outer surface of the protective cap 20. The body 51 may be fastened by any suitable means in the recess 46, for example by bonding.

The body 51 also includes a through-housing 54 to allow the lug 44 to pass through it so that it is accessible to the user from the outside. The lug 44 is, in one example, approximately flush with the outer surface of the body 51. The body 51 may be made of an elastomer, such as a rubber, for example, natural rubber (NR) or polyisoprene (IR), polybutadiene (BR), a butadiene-styrene copolymer (SBR), polychloroprene (CR), an acrylontrile-butadiene copolymer (NBR), a silicone, etc., or an olefinic thermoplastic elastomer (OTP) or a vulcanized thermoplastic elastomer (VTP) having for example a thickness of between 0.5 and 1 mm, or else by molding a thermoplastic resin that is more flexible than that used for the protective cap 20, such as polyvinyl chloride (PVC), an ethylene/vinyl acetate copolymer (EVA) or very low-density polyethylene (VLDPE). The thermoplastic resin of the body 51 may for example have a Shore A hardness of between 30 and 70, especially between 50 and 70. The Shore A hardness of the protective cap 20 may be greater than 80.

By using the covering means 50, it is possible to reduce, at the releasing means, the ingress of air or contaminants into the cap 20, and especially in the region of the product stick S, which might impair the physico-chemical properties thereof. The covering means 50 also make it possible in this region to limit the risk of loss of volatile compounds contained in the stick S.

Thus, the covering means 50 form a seal mounted on the cap 20 so as to better seal the assembly formed with the support base 22.

In other words, the covering means 50 may provide, on the one hand, a static sealing function with the body 30 of the cap 20, and, on the other hand, a dynamic sealing function with the lug 44 when the user presses on it to disconnect the cap 20 and the support base 22. Here the term "static sealing" is understood to mean the sealing which is produced between two parts that do not undergo relative movement and the term "dynamic sealing" is understood to mean the sealing between two parts that do undergo a relative movement.

Moreover, the covering means 50 may improve the handleability of the protective cap 20 in so far as the material used for the body 51 is may be sufficiently flexible or rough for the user's fingers to grip better thereon.

In this embodiment, the protective cap 20 has a single means for releasing the system 12, comprising the hook 42 and the lug 44. An alternative example provides two diametrically opposed releasing means. Thus, to release the system 12, it is necessary to press on the two releasing means, thereby limiting the risk of unintentionally disconnecting the system 12 and the protective cap 20, for example when in a handbag.

Figure 9:
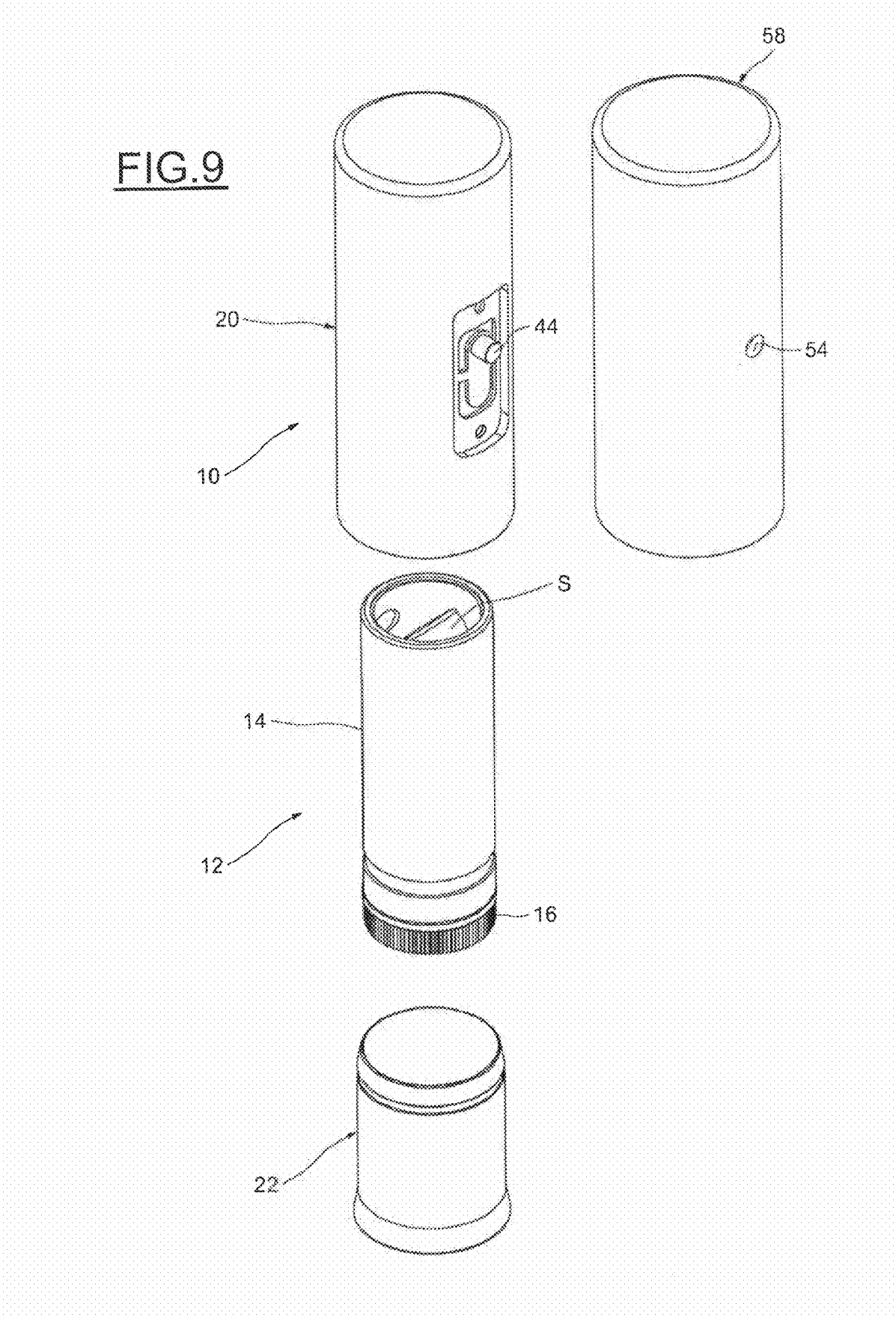
FIG. 9 is an exploded perspective view of a protection device for a product packaging/dispensing system according to a second embodiment.
Figure 10:
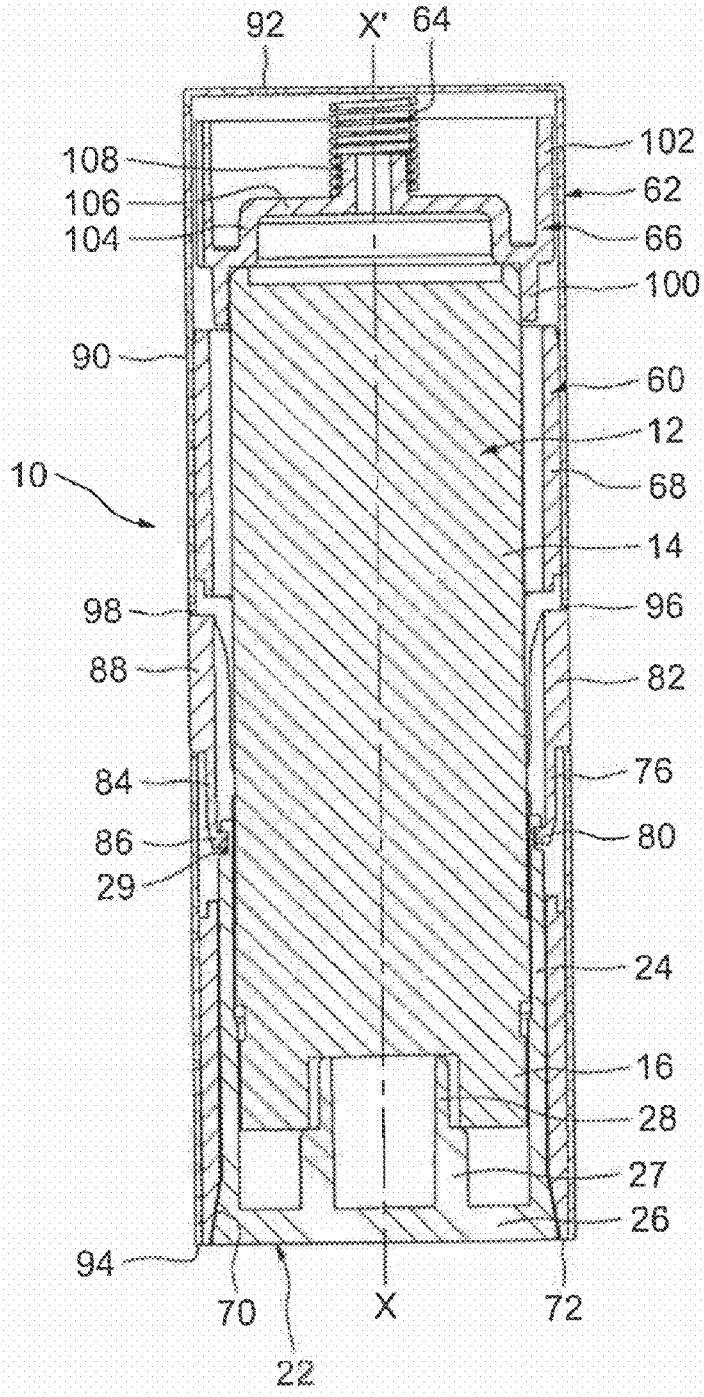
FIG. 10 is a sectional view of a protection device for a product packaging/dispensing system according to a third embodiment.
Figure 11:
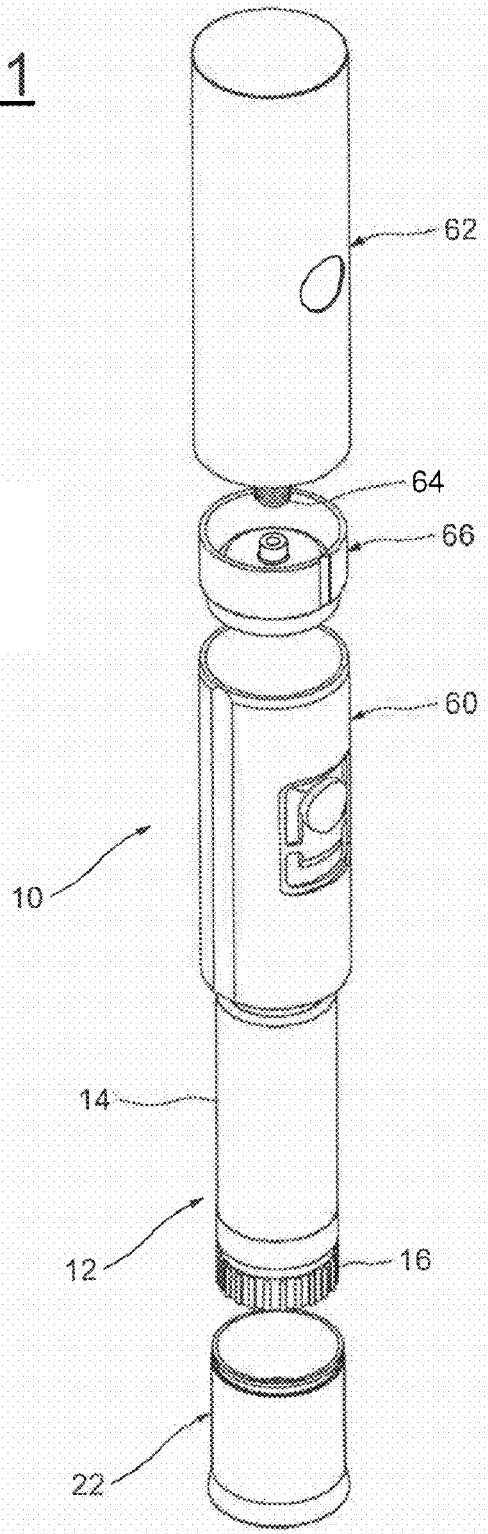
FIG. 11 is an exploded perspective view of the device of FIG. 10.

In the embodiment illustrated in FIG. 9, in which the identical elements bear the same references, the device 10 includes covering means 58 taking the form of an envelope surrounding the protective cap 20 over its entire height and coming into contact therewith. The covering means 58 comprise, on the inside and made as one piece with the envelope, a body (not visible) identical to the body 51 of the first embodiment. In this embodiment, the lug 44 may have a substantially greater thickness so as to be flush with the outer surface of the envelope of the covering means 58 so as to be easily accessible to the user from the outside. The covering means 58 may be fastened to the protective cap by any suitable means, for example by bonding, by two-shot injection molding, by overmolding, etc. . . .

In the embodiment illustrated in FIGS. 10 to 13, in which the elements similar to the first embodiment bear the same references, the device 10 comprises a protective cap 60, for protecting the packaging system 12, a cover or envelope 62 mounted around the cap, and means 64, 66 for exerting an axial force between these two elements.

The protective cap 60 typically includes a tubular body 68 of axis X-X', surrounding the body 24 of the support base 22 and bearing against the latter. It includes, at a lower axial end, an internal surface 70 of corresponding shape to and in contact with the outer frustoconical surface of the radial wall 26 of the support base 22. A lower transverse end surface 72 is flush with the lower end of the radial wall 26 of the support base 22. The protective cap 60 is typically shaped so as to leave an upper end of the packaging system 12 free. In other words, the upper end of the system projects axially with respect to the upper end of the protective cap 60. However, the cap 60 may axially cover at least 90% of the system 12 and preferably 100% of the system.

Figure 12:
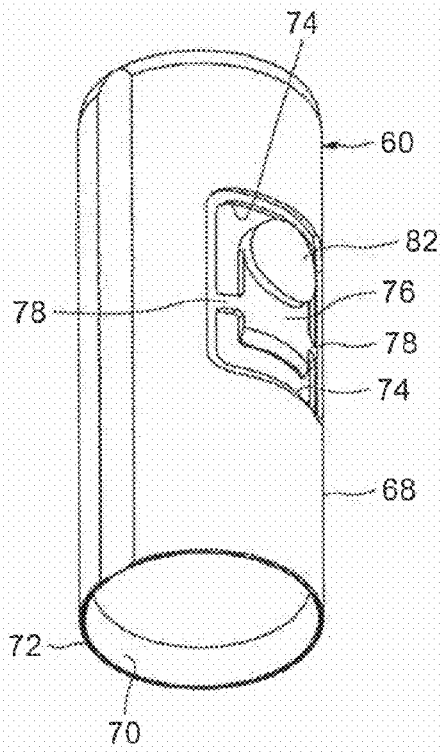
FIGS. 12 and 13 are perspective and sectional views, respectively, of a cap of the device of FIG. 10.
Figure 13:
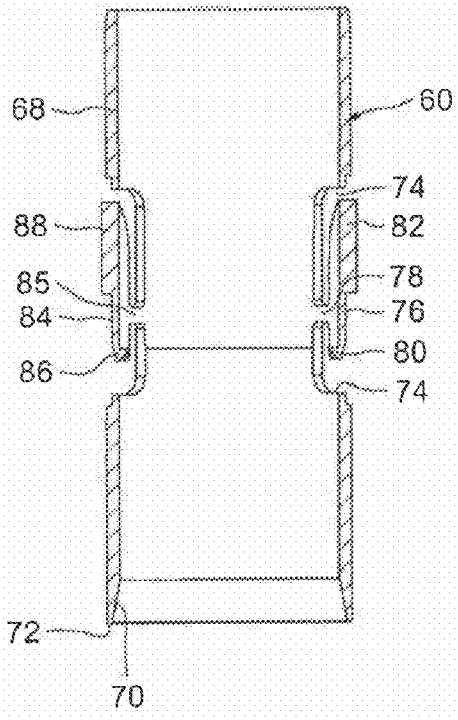

As illustrated in FIGS. 12 and 13, the protective cap 60 includes two identical means for releasing the system 12, these being diametrically opposed and of a design similar to the releasing means of the first embodiment described above. Alternatively, the protective cap 60 may have a single means for releasing the system 12.

To obtain one of the releasing means, the protective cap 60 may include, provided on the body 68, two generally C-shaped notches 74 defining a tongue 76 connected to the body 68 via two circumferentially opposed hinges 78. Similarly to the first embodiment described, the tongue 76 has, on the inside, a radial hook 80 extending towards the inside and arranged to cooperate with the annular groove 29 of the support base 22 so as to retain the base and the packaging system 12. The tongue 76 also includes, on the outside, a radial lug 82 forming a means for actuating the hook 80, as was described in the first embodiment. The second releasing means similarly includes a tongue 84 connected to the body via hinges 85, a hook 86 and a lug 88 for actuating the hook. In this embodiment, the radial dimension of the lugs 82, 88 is designed so that they project slightly radially outwards relative to the body 68.

Again referring to FIGS. 10 and 11, the envelope 62 has an annular body 90 of axis X-X', surrounding the protective cap 60 and coming into contact therewith. The body 10 is closed off at an upper axial end by a radial wall 92 located at some distance from the upper end of the packaging system 12 and left free by the cap 60. The envelope 62 has, at the opposite axial end, a transverse surface 94 flush with the transverse surface 72 of the protective cap 60. The envelope 62 also has two diametrically opposed circular openings 96, 98 provided so as to allow access to the lugs 82 and 88 of the cap 60 from the outside. The lugs 82 and 88 are approximately flush with the outer surface of the body 90. The envelope 62 forms means for covering the protective cap 60 so as to limit the ingress of air or contaminants into the latter. The envelope 62 entirely covers the packaging system 12. Apart from the lugs 82, 88 and the transverse surface 72, the envelope 62 covers the protective cap 60. The envelope 62 may be made of a metallic material, such as steel, or else may be obtained by molding a thermoplastic, for example a polyolefin (PO), or else may be made of wood.

As indicated above, the device 10 includes means 64, 66 for exerting an axial force between the radial wall 92 of the envelope 62 and the packaging system 12. These means may respectively comprise an elastic return member, such as a helical spring 64, and a retainer 66 for supporting the member.

In the depicted example, the support retainer 66 has includes an annular centering portion 100 fitted onto that upper end of the system 12 which is left free by the protective cap 60, which portion is extended axially at an upper end by an external skirt 102 extending up to close to the radial wall 92 of the envelope 62 and an internal skirt 104 of smaller axial dimension. The skirts 102, 104 are coaxial with the axis X-X'. The internal skirt 104 is extended, at a radially inward upper end, by a radial portion 106 which is itself extended at a smaller-diameter edge by an annular stud 108 extending axially towards the radial wall 90 of the envelope 62. The stud 108 serves to center the helical spring 64, one axial end of which bears against the radial wall 106. The opposite end of the spring 64 bears against the radial wall 92 of the envelope 62.

When access to the packaging system 12 is desired, the user exerts an inwardly directed force on the lugs 82 and 88 so as to move the hooks 80 and 86 outwards. The spring 64 helps the system 12 to slide out of the envelope 62 and the protective cap 60. In this regard, a slight radial clearance (not shown) is provided between the system and the centering portion 100 of the retainer 62.

Figure 14:
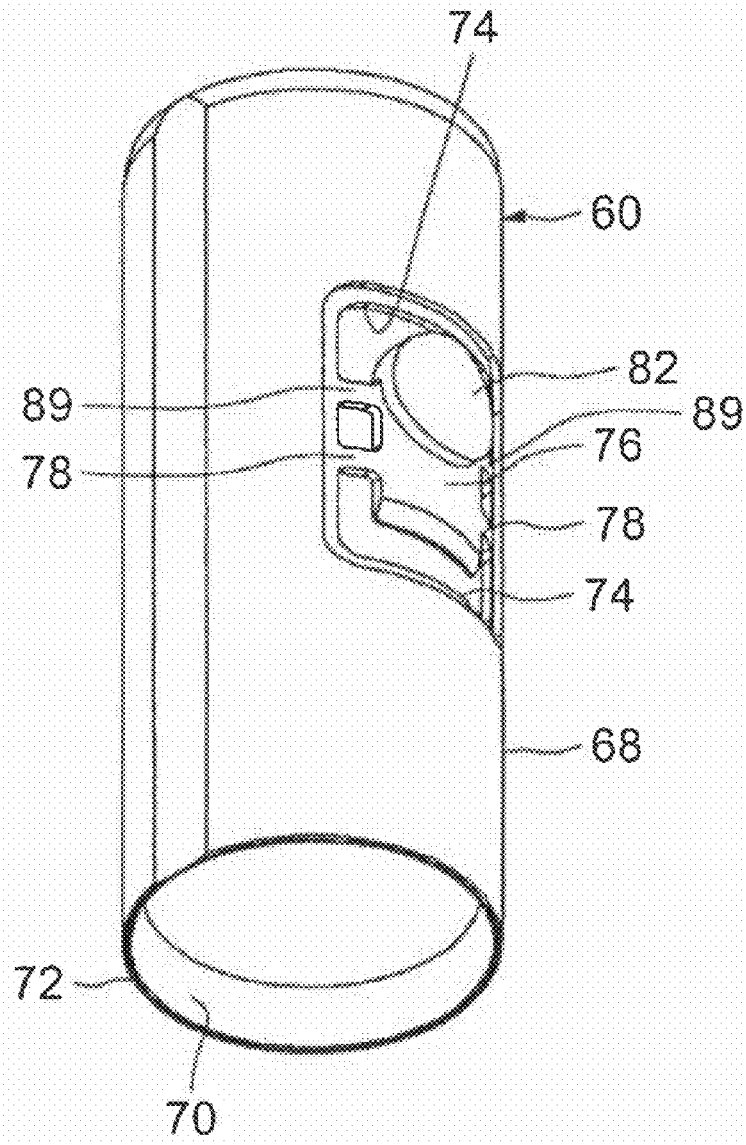
FIG. 14 is a sectional view of a cap of a protection device for a product packaging/dispensing system according to a fourth embodiment of the invention.

The embodiment illustrated in FIG. 14 differs from the previously described embodiment in that the protective cap 60 has circumferentially opposed bridges of material or hinges 89 that connect the tongue 76 to the body 68. The hinges 89 are upwardly offset with respect to the hinges 78, being located approximately level with the lug 82. Similarly, additional hinges are also provided between the tongue 84 (not visible in this figure) and the body 68 of the cap. Provision of such additional tongues makes it more difficult to pivot the tongues of the cap 60 and to release the packaging system.

Figure 15:
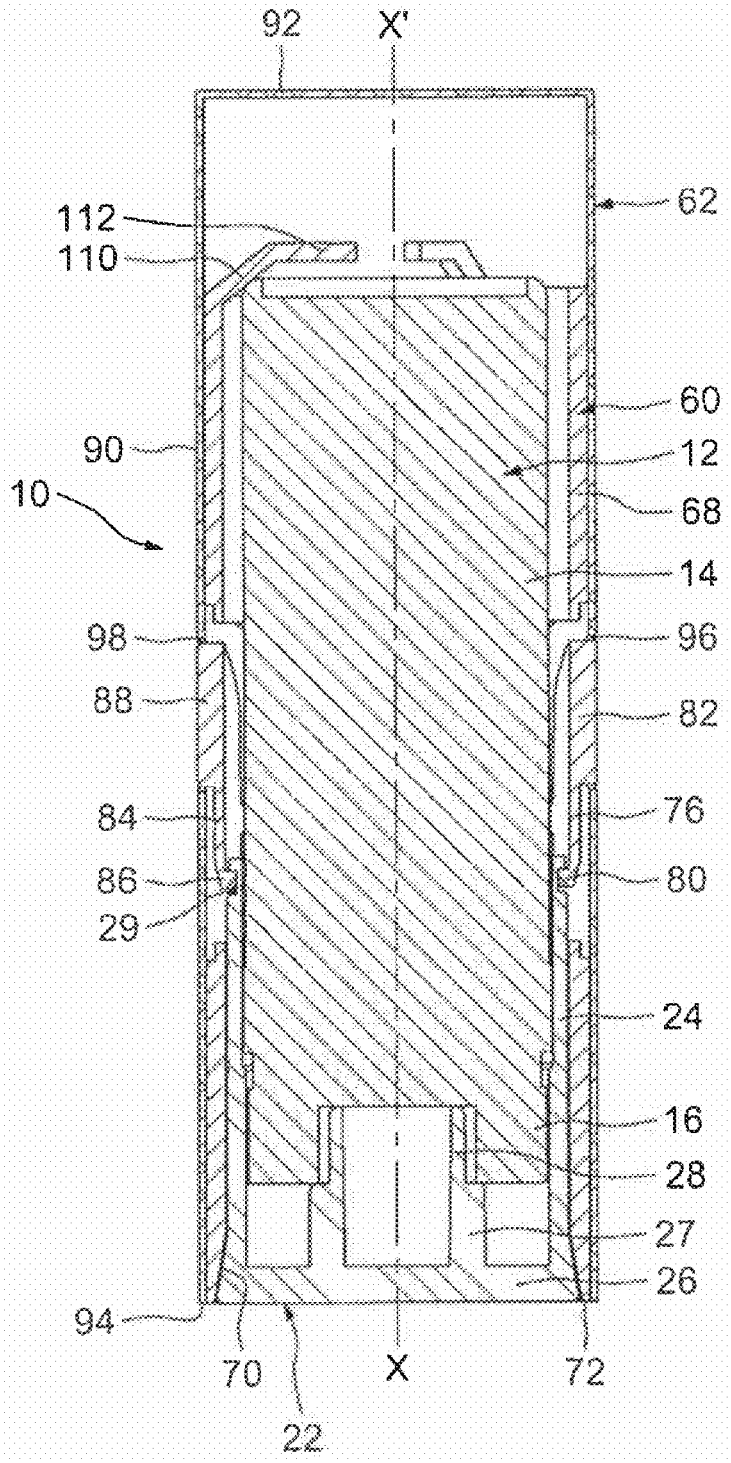
FIG. 15 is a sectional view of a protection device for a product packaging/dispensing system according to a fifth embodiment of the invention.
Figure 16:
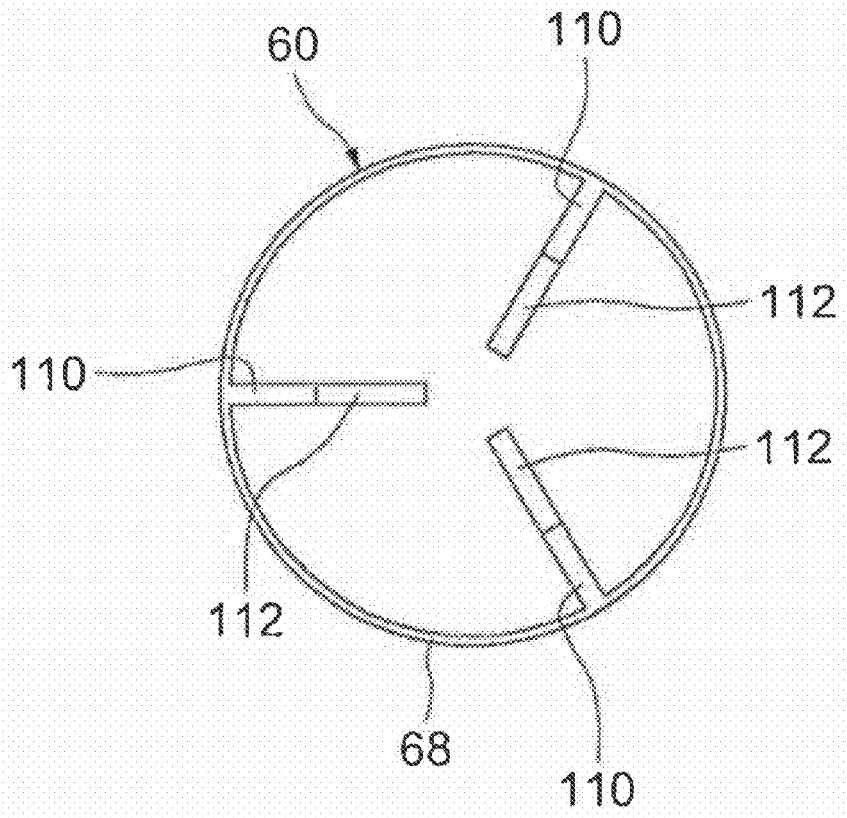
FIG. 16 is a top view of a cap of the device of FIG. 15.

The embodiment illustrated in FIGS. 15 and 16, on which the identical elements bear the same references, differs from the previously described embodiment in that the protective cap 60 has, at its upper end, fins or tongues 110 extending obliquely upwards and bearing against the upper end of the packaging system 12. Each tongue 110 is extended, from a small-diameter edge, by an inwardly extending radial portion. Here, there are three tongues 110 uniformly distributed around the circumference of the body 68 of the protective cap 60. The tongues 110 form means for applying downward axial stress on the packaging system 12. These tongues are integrated into or made as one piece with the body 68.

Thus, when the user presses on the lugs 82 and 88 in order to disconnect the base 22 relative to the protective cap 60, the tongues 110 tend to push the packaging system 12 axially downwards. In this regard, when the system 12 is housed inside the protective cap 60, it deforms the tongues axially upward so as to obtain this downward axial force when the lugs 82 and 88 are pressed. The protective cap 60 is advantageously made from a rolled-up thin metal sheet on which the tongues 110 are formed beforehand, and then the ends of the sheet are butted together and bonded so as to form a tubular cap. As a variant, it would be possible to provide a cap 60 which is open at one point on its circumference.

Figure 17:
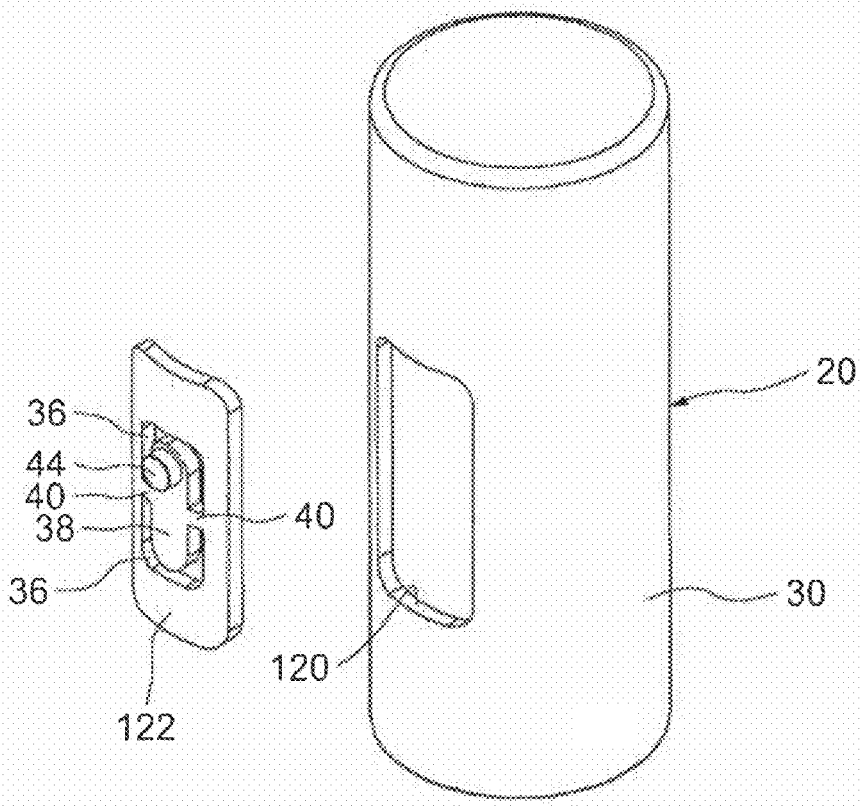
FIG. 17 is a perspective view of a cap of a protection device for a product packaging/dispensing system according to a sixth embodiment of the invention.

The embodiment illustrated in FIG. 17 differs from the first embodiment in that the protective cap 20 includes a through-window 120 provided in the body 30, the releasing means, including the tongue 38 bounded by the notches 36, the hinges 40, the lug 44 and the hook 42 (not visible in the figure), being fastened by any suitable means inside the window. The releasing means here comprises a rectangular support frame 122 connected to the hinges 40 and enabling the releasing means to be fastened by any suitable means inside the window 120.

In other embodiments, it would also be possible to provide, in the case of the second and third embodiments of the invention, similar releasing means attached to the body of the protective cap.

In the embodiments described above, the means for axially retaining the protective cap cooperates with the support base so as to constitute the unitary assembly formed by the cap and the product packaging system. However, it is also possible, without departing from the scope of the invention, to provide a protection device that cooperates directly with the packaging system so as to retain the device on the system.

Figure 18:
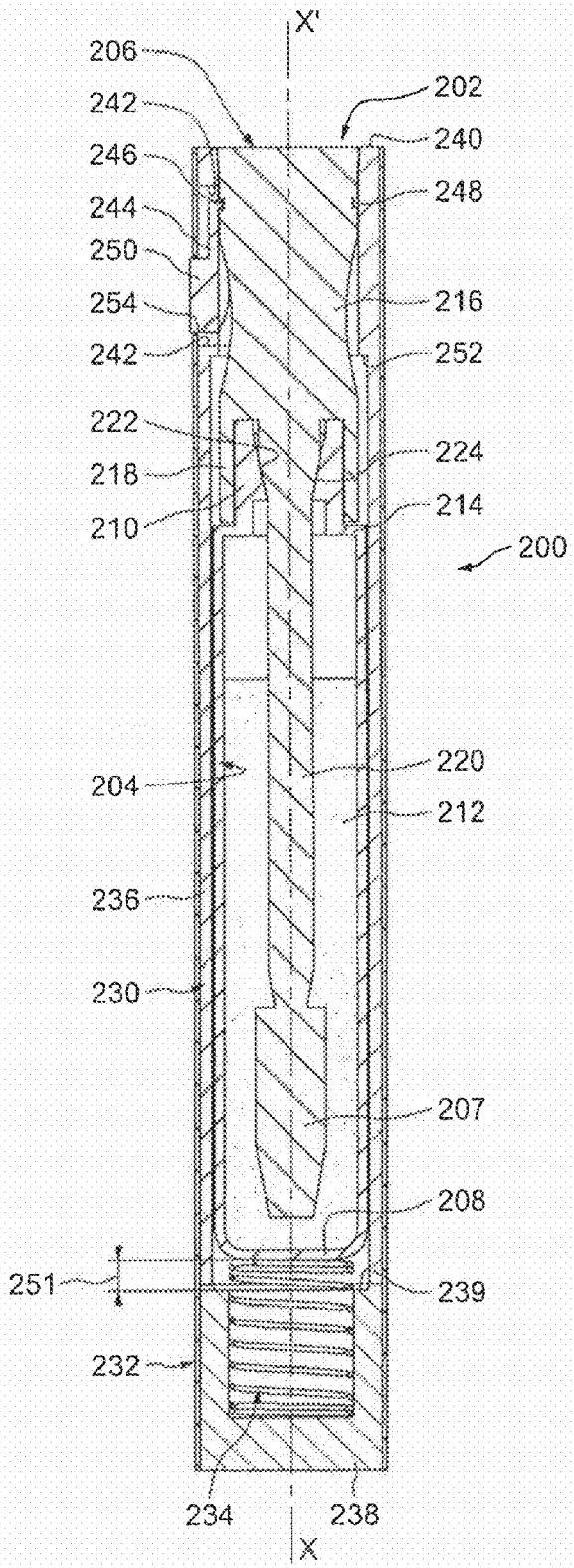
FIGS. 18 and 19 are sectional views of a protection device for a product packaging/dispensing system according to a seventh embodiment of the invention.
Figure 19:
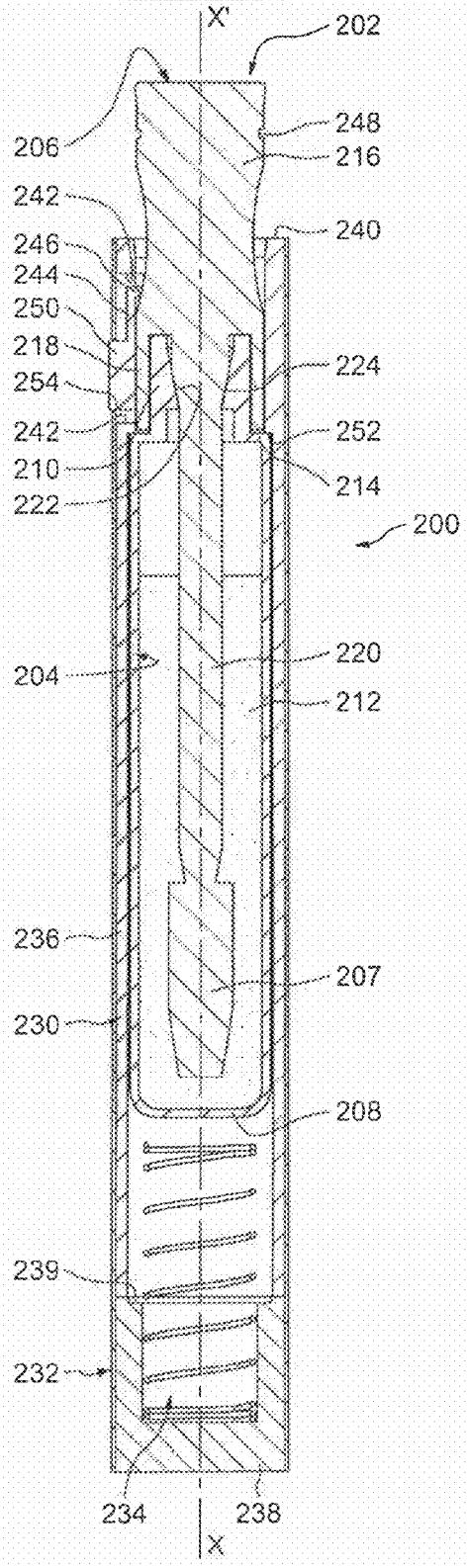

FIGS. 18 and 19 show a protection device 200 cooperating directly with a packaging system 202 in order to retain the device on the system.

The system 202 is designed for packaging various products such as a cosmetic product of the nail varnish, mascara, hair or gloss type. The depicted system comprises a container 204 for the cosmetic product and a closure member 206 that bears an applicator 207 serving to apply the product contained in the container.

In the depicted embodiment, the container 204 has a body provided with a closed lower end forming the bottom 208 and with an open opposed end forming the neck 210. On the inside, it defines a space 212 filled with the cosmetic product. Provided between the neck 210 and the peripheral wall of the container 204 is a radial shoulder 214. The container 204 extends along a vertical axis X-X' forming the longitudinal axis of the system 202. The neck 210 is centered on the axis X-X'.

The closure member 206 itself comprises a closure cap 216 of cylindrical general shape, a lower radial transverse surface of which is provided so as to bear against the upper end of the neck 210 so as to close off the container 204. This surface is extended axially downwards by a skirt 218 centered on the axis X-X'. The skirt 218 extends down to the immediate vicinity of the shoulder 214 of the container 204 and radially surrounds the neck 210, coming into contact therewith.

As indicated above, the closure member 206 is provided with an applicator 207. This applicator 207 is carried by a mount or stem 220 integral with the cap 216 and extending axially downwards from the lower transverse surface thereof. The stem 220 may be molded with the cap 216 and extends along the axis X-X' when the closure member 206 is mounted on the neck 210 of the container. The length of the stem 220 corresponds overall to the height of the container 204 so that, when the closure member 216 is mounted on the neck, the applicator 207 is in the bottom of the container.

The applicator 207 may comprise a foam, a felt, a flocked end-piece, a frit, a woven fabric, a sponge, a fine brush or other brush, with a twisted or non-twisted core, a molded brush, a comb or else a porous thermoplastic so as to allow the product contained in the container 204 to be applied.

As indicated above, the skirt 218 and the cap 216 of the closure member 206 bear against the neck 210 of the container 204, thereby sealing it.

To obtain good sealing between the closure member 206 and the neck 210, the latter has, on the inside, a bore 222 of frustoconical general shape flaring towards the inside of the container 204 and designed to cooperate with complementary frustoconical surface 224 provided at the root of the stem 220.

The cooperation of the frustoconical surface 224 of the stem 220 with the bore 222 of the neck 210 promotes good sealing between the closure member 206 and the container 204. In other words, the frustoconical surface 224 of the stem 220 seals off the bore 222 of the neck 210 so as to prevent the product contained inside the container 204 from flowing to the outside. The stem 220 is held sealed in the neck 210 of the container. Furthermore, this cooperation also enables these two elements to be maintained in axial relative position by friction.

In this example, the protection device 200 comprises a cap 230, arranged to cover the packaging system 12, a cover or envelope 232 mounted around the cap, and return means 234 for exerting an axial force on the container 204 for the purpose of maintaining a good seal between the closure member 206 and the container.

The protective cap 230 is advantageously made as a single part by molding a thermoplastic, for example a polyolefin (PO). As a variant, the protective cap 230 may be made from a metallic material, such as steel, for example from a thin sheet wound up and bonded so as to form a cylinder.

The protective cap 230 typically has a tubular body 236 extending along the axis X-X', surrounding the peripheral wall of the container 204. The body 236 includes, at a lower axial end, an attached end-piece forming a bottom 238 located axially at some distance from the bottom 208 of the container 204. The bottom 238 may be attached to the body 236 by any suitable means, for example by screwing, bonding or snap-fastening. As will be described in greater detail later, the return means 234 are placed axially between the bottom 208 of the container 204 and the bottom 238 of the cap 230.

The cap 230 has, at an upper axial end, an upper transverse end surface 240 flush with the upper end of the closure member 206 and radially surrounding it. The system 202 is therefore entirely housed inside the protective cap 230. The protective cap 230 entirely covers the system 202 in relation to the axial direction. In this position, no part of the system 202 can therefore be handled by the user.

The protective cap 230 includes a means for releasing the system 202, the means being of a similar design to one of the two releasing means of the third embodiment of the invention described above.

In one example of the releasing means, the protective cap 230 has, provided on the body 236 near its upper axial end, two generally C shaped notches 242 defining an axial tongue 244 connected to the body via two circumferentially opposed bridges of material or hinges (not visible). These hinges form a pivot pin for the tongue 244.

The tongue 244 has, on the inside, a radial hook 246 extending inwards and intended to cooperate with an annular groove 248 provided on the outer surface of the cap 216 of the closure member 206, near its upper end.

Figure 20:
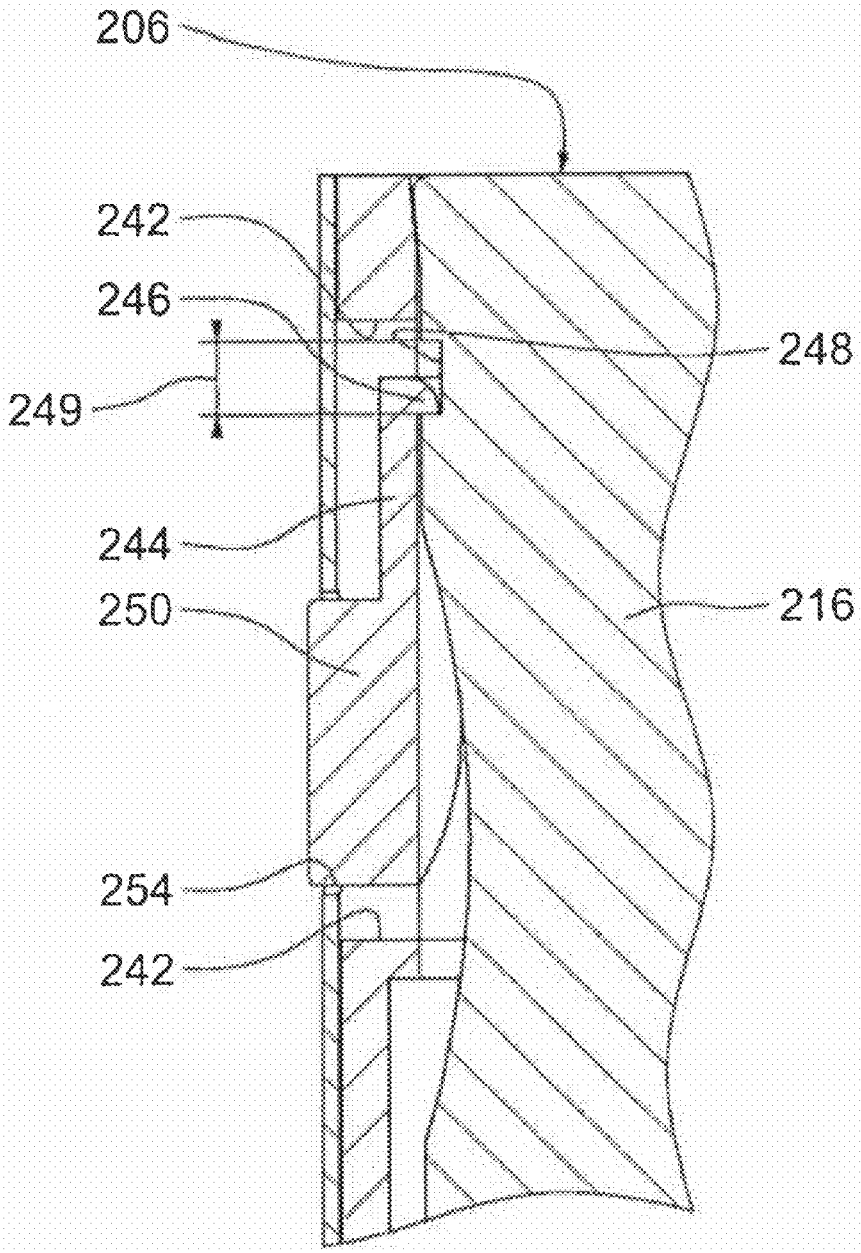
FIG. 20 is a partial section on a larger scale of FIG. 18.

The hook 246 and the groove 248 serve to retain the closure member 206, and more generally the system 202, inside the protective cap 230. The hook 246, provided on the inner face of the tongue 244, has a smaller diameter than that of the cap 216 of the closure member 206 so that there is diametral interference between these two parts, at the hook 246 and the groove 248. The hook 246 forms a means for axially retaining the packaging system 12 relative to the protective cap 230 so as to form a unitary assembly. In other words, the hook 246 forms means for snap-fastening the cap 230 onto the closure member 206. The hook 246 is located axially on a portion of the tongue 244 located above the hinges, bearing the articulation of the tongue. As shown in FIG. 20 and as will be described in more details below, the axial dimension 249 of the groove 248 is greater than the axial dimension of the hook 246 notably to compensate the manufacturing tolerances.

To allow the cap 230 to be disconnected from the system 202, the tongue 244 also includes, on the outside, a radial lug 250 forming a means for actuating the hook 242. The lug 250 is provided on the outer surface of the tongue 244 and extends radially outwards. It is located axially on the opposite side from the hook 246 when considering the hinges allowing articulation of the tongue 244. Here, the lug 250 has a cylindrical general shape. Another aspect provides a lug of substantially different shape, having for example a rotationally symmetrical cross section. One example provides a polygonal cross section.

As indicated above, the hinges of the tongue 244 form a pivot pin for the latter. The lug 250 and the hook 246 are located axially on either side of this pivot pin. Consequently, when a user presses on the lug 250, exerting a force directed towards the inside of the cap 230, the tongue 244 pivots, this having the effect of moving the hook 246 away to the outside and of releasing the cap 216 of the closure member 206, and more generally the system 202.

The return means 234 are used to make it easier for the system 12 to slide out of the protective cap 230 when the releasing means are actuated. The return means may comprise a helical spring, one end of which bears against the bottom 238 of the cap 230 and the other end of which bears against the bottom 208 of the container 204. The spring is dimensioned so as to be stressed or compressed axially between the cap 230 and the container 204 when the hook 246 is engaged with the groove 248 of the closure member 206 in order to retain the system 202 inside the device 200. The return means 234 thus promote good overall sealing insofar as the force exerted by these means helps to maintain the axial contact between the neck 210 and the cap 216 of the closure member 206 and to jam the neck 210 of the container against the frustoconical surface 224 of the stem 220.

Once the hook 246 has moved away from the groove 248, the return means 234 help the system 12 to slide out of the protective cap 230 of the device 200, and more precisely the cap 216 of the closure member 206.

To prevent the container 204 from being extracted from the protective cap 230, the latter has, on the inside, a radial shoulder 252 located axially beneath the lug 250 and forming a stop surface that cooperates with the shoulder 214 of the container, as illustrated in FIG. 19, when the user grips the closure member 206. Thus, the container 204 remains housed inside the protective cap 230 of the device 200 and the closure member 206, bearing the applicator 207, is disconnected from the container 204 for the purpose of applying the product.

When the closure member 206 is gripped by the user and separated from the container 204, the bore 222 of the neck 210 of the container enables the surplus product present on the applicator 207 to be removed, so that only the correct dose to be applied remains on the applicator. In this regard, the minimum diameter of the bore 222 is slightly less than the diameter of the applicator 207 so as to promote greater wiping by increasing the pressure exerted by the applicator 207 on the bore 222, this being particularly useful when there is considerable surplus product. Thus, when the applicator 207 is extracted from the container 204, the applicator rubs against the bore 222 and is therefore wiped. The bore 222 thus provides a wiping member.

After the applying of the product, the user can put the applicator 207 back into the container 204 and the closure member 206 into the protective cap 230. In order to make sure of the good sealing between the stem 220 of the applicator 207 and the neck 210 of the container 204, the bottom 238 comprises, on the inside, a radial shoulder 239 oriented axially towards the container 204. When the user inserts the applicator 207 into the container 204, the closure member 206 bears against the neck 210 and the container 204 moves axially towards the bottom 238 into the cap 230 until the bottom 208 comes into contact against the shoulder 209. Thus, under the effect of the axial force exerted by the user, a good wedging of the stem 200 into the bore 222 of the container 204 is obtained. When the bottom 208 of the container bears against the shoulder 239, the return means 234 are axially compressed. Once the user releases the pressure exerted on the closure member 206, the return means 234 generate the axial movement of the container 204 and of the closure member 206. The hook 246 thus cooperates with the lower surface of the groove 248 as shown in FIG. 20. In order to allow the displacement of the closure member 206 and of the container 204 until the bottom 208 comes into contact against the shoulder 239, the axial dimension 249 of the groove 248 is greater than the axial gap 251 between the bottom 208 and the shoulder 239 when the hook 246 cooperates with the lower surface of the groove 248. More precisely, the axial gap 251 between the upper surface of the hook 246 and the upper surface of the groove 248 is at least equal to the gap 251.

The generally annular-shaped envelope 232 of axis X-X' surrounds the protective cap 230 and comes into contact with the latter. The lower and upper axial ends of the envelope 232 are flush with the lower surface of the bottom 238 and the upper transverse surface 240, respectively. The envelope 232 has a circular opening 254 designed to allow access to the stud 250 of the cap 230 from the outside. The stud 250 is dimensioned so as to be at least flush with the outer surface of the envelope 232. The envelope 232 forms means for covering the cap 230 so as to limit the ingress of air or contaminants into the latter. Apart from the lug 250 and the lower and upper transverse surfaces 240, the envelope 232 typically covers the protective cap 230. Alternatively, the envelope 232 may also cover the lower axial end of the bottom. In another embodiment, the bottom 238 and the cap are made as one integral part. The envelope 232 may be made of a metallic material such as steel, or it may be obtained by molding a thermoplastic, for example a polyolefin (PO), or else made of wood.

Variants of all the embodiments described above provide a protective cap that does not have a housing for passage of the actuating lug or lugs but does include, as a replacement, on the outer surface of the cap, a logo, a pictogram or else a region of different color from that of the rest of the cap so as to indicate to the user where pressure is to be applied in order to disconnect the product packaging system and the cap.

Figure 21:
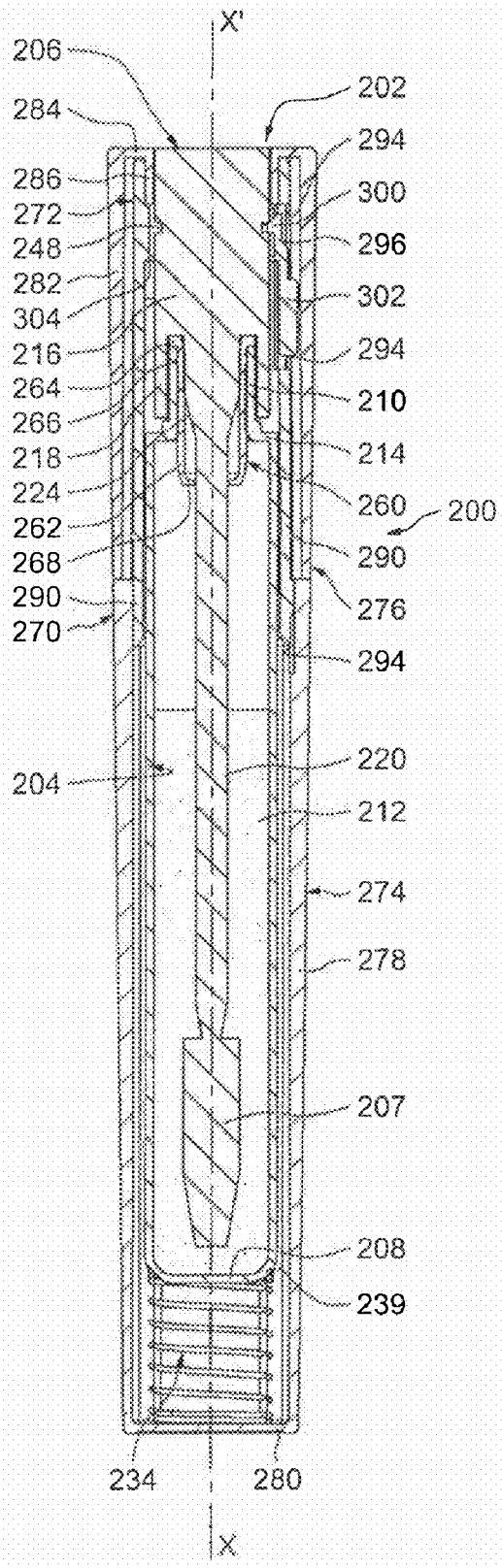
FIGS. 21 and 22 are sectional views of a protection device for a product packaging/dispensing system according to an eighth embodiment of the invention.
Figure 22:
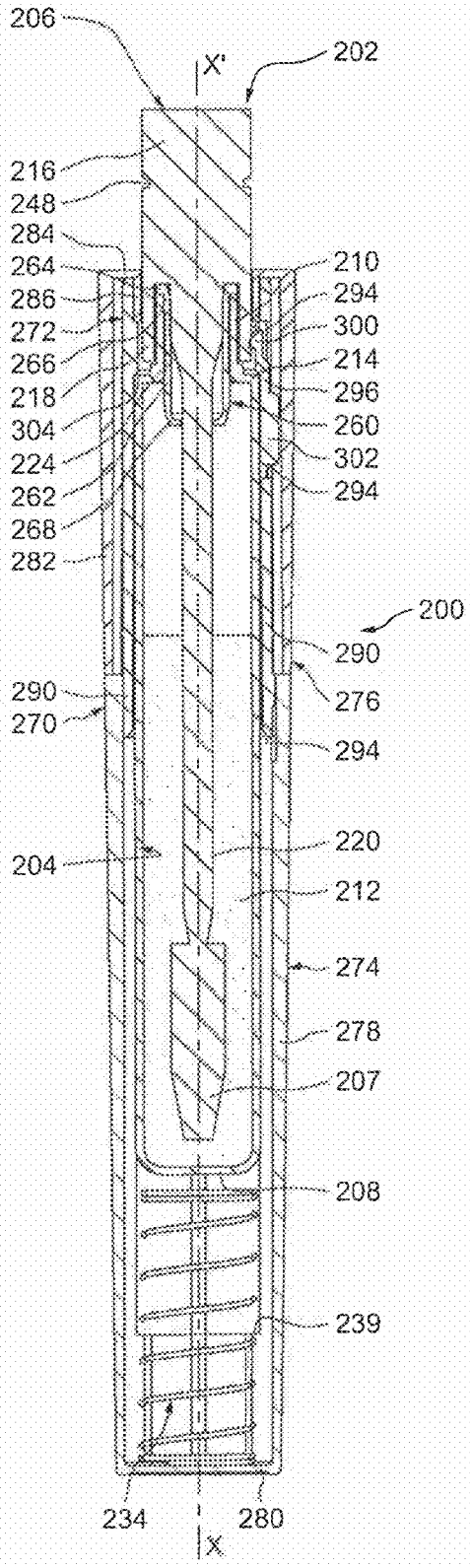
Figure 23:
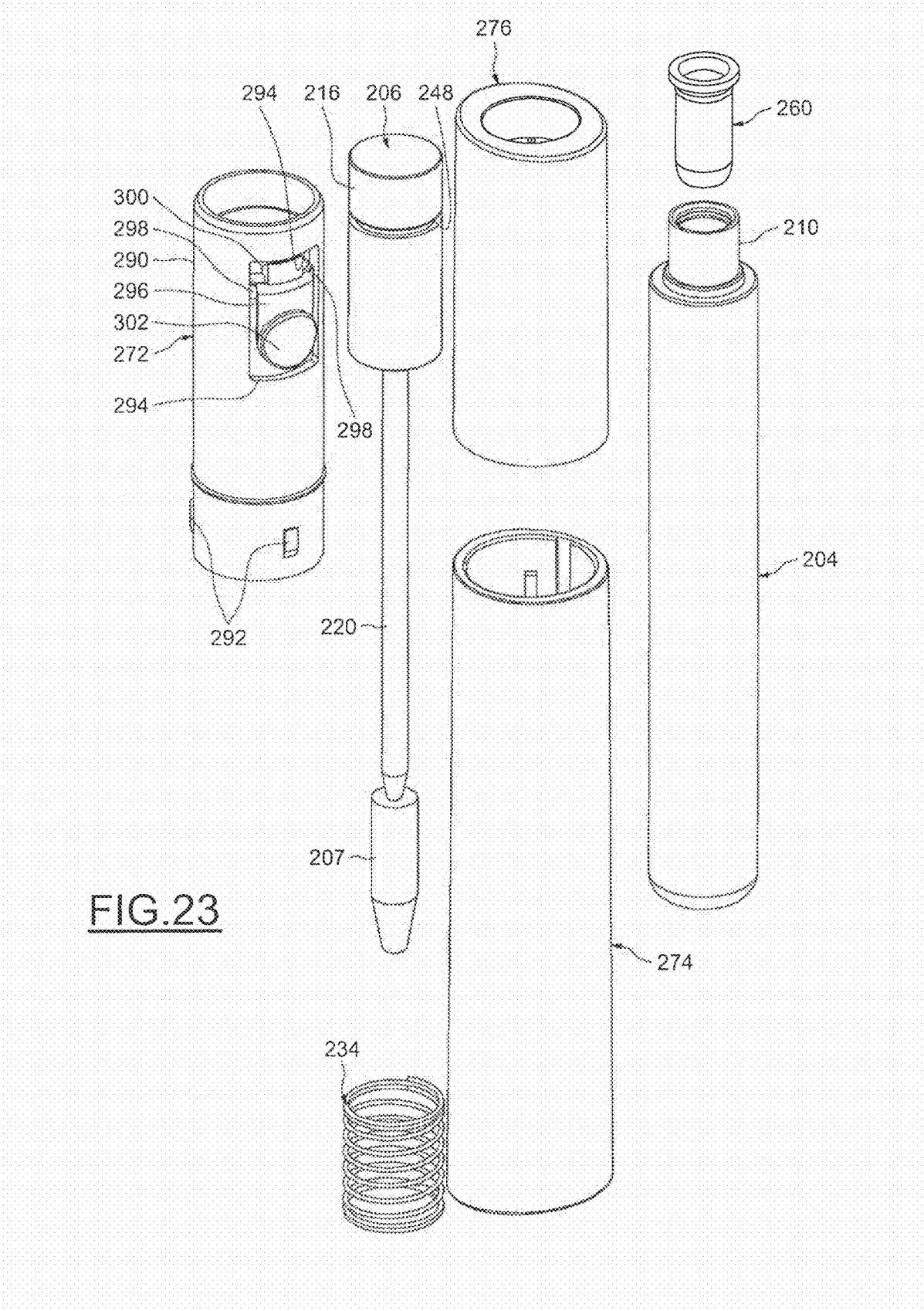
FIG. 23 is an exploded perspective view of the device of FIGS. 21 and 22.
Figure 24:
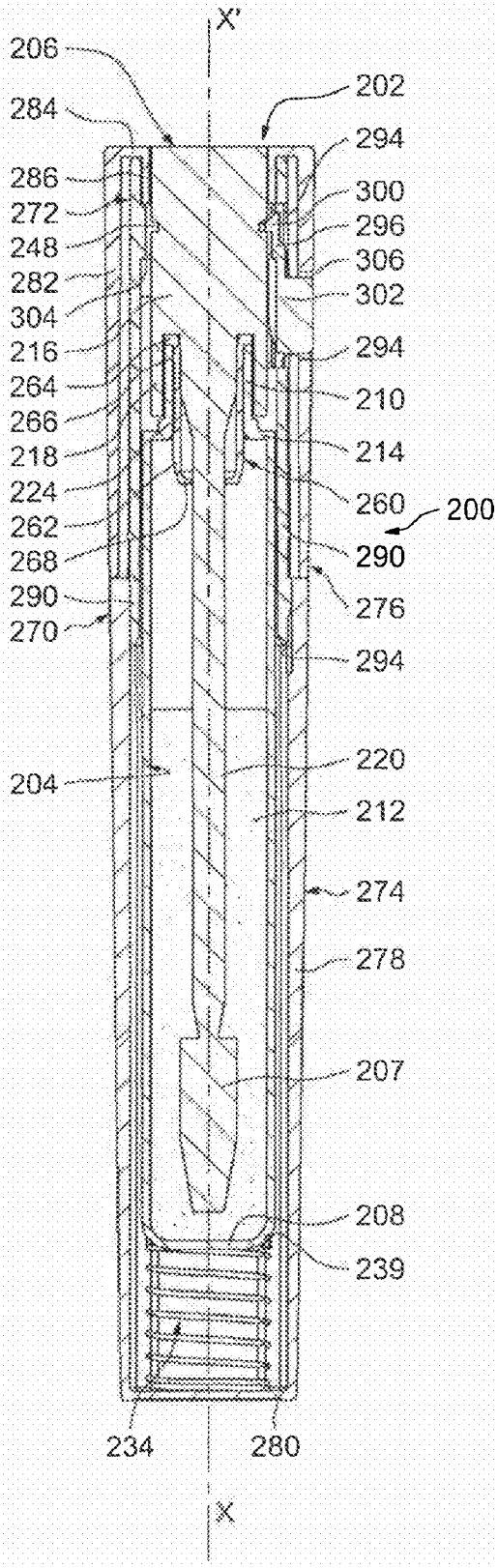
FIG. 24 is a sectional view of a protection device for a product packaging/dispensing system according to a ninth embodiment of the invention.
Figure 25:
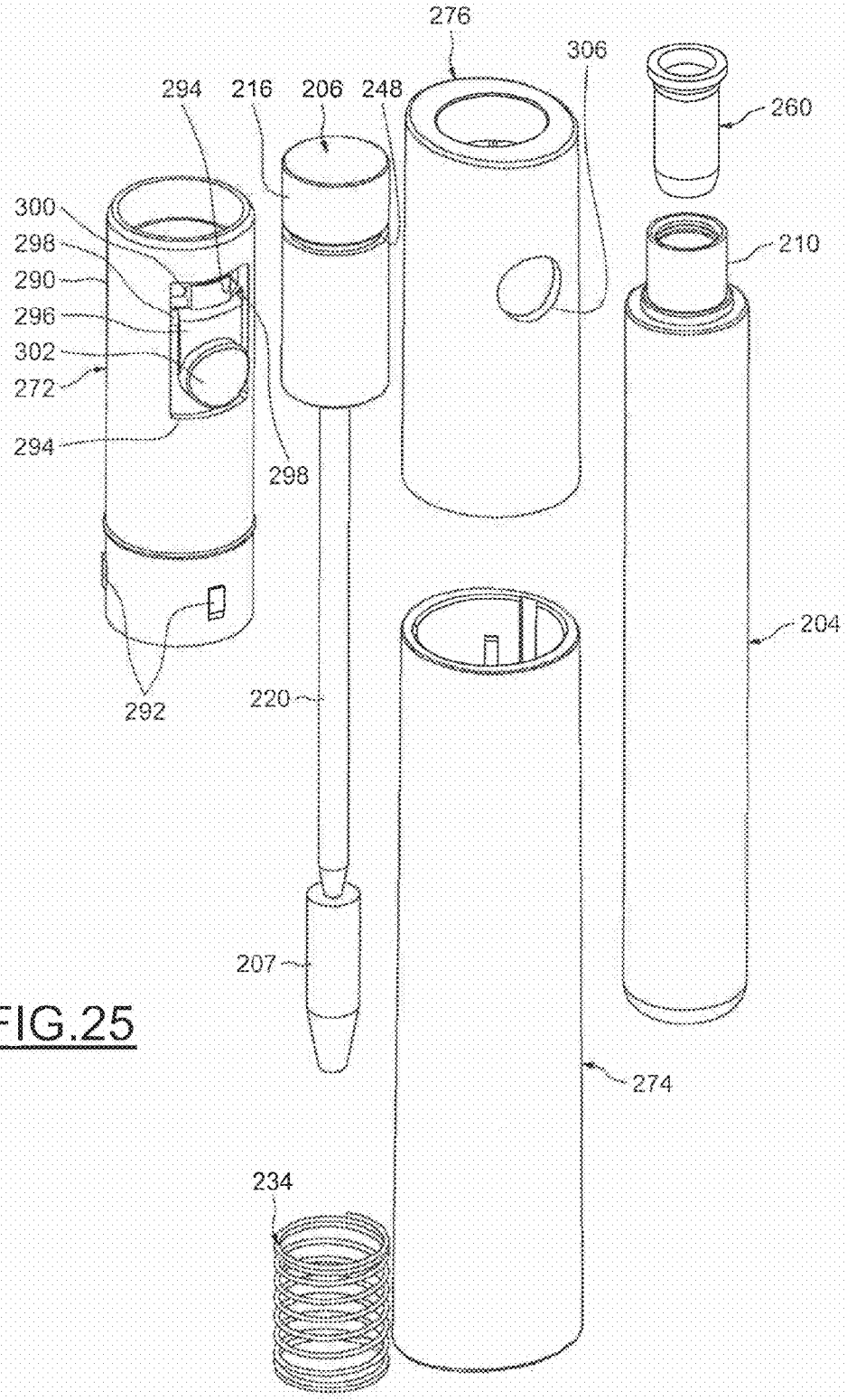
FIG. 25 is an exploded perspective view of the device of FIG. 24.
Figure 26:
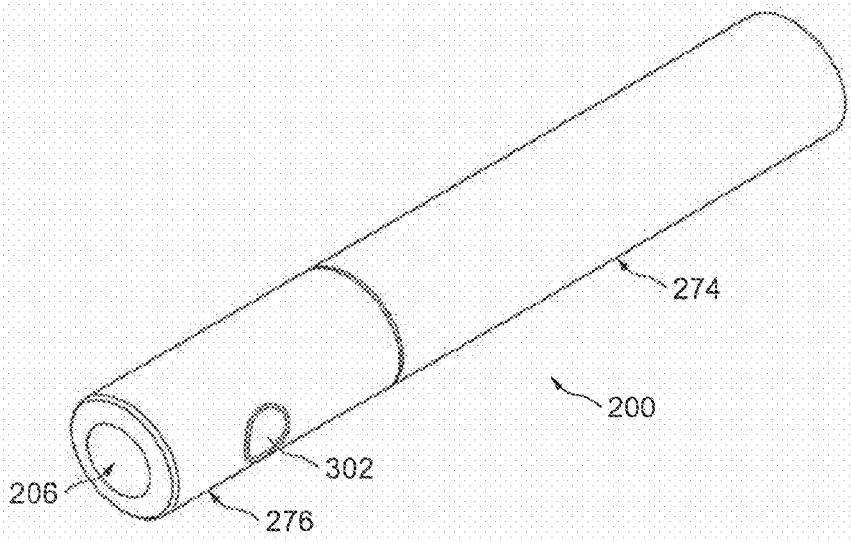
FIGS. 26 and 27 are perspective views of the device of FIGS. 24 and 25.
Figure 27:
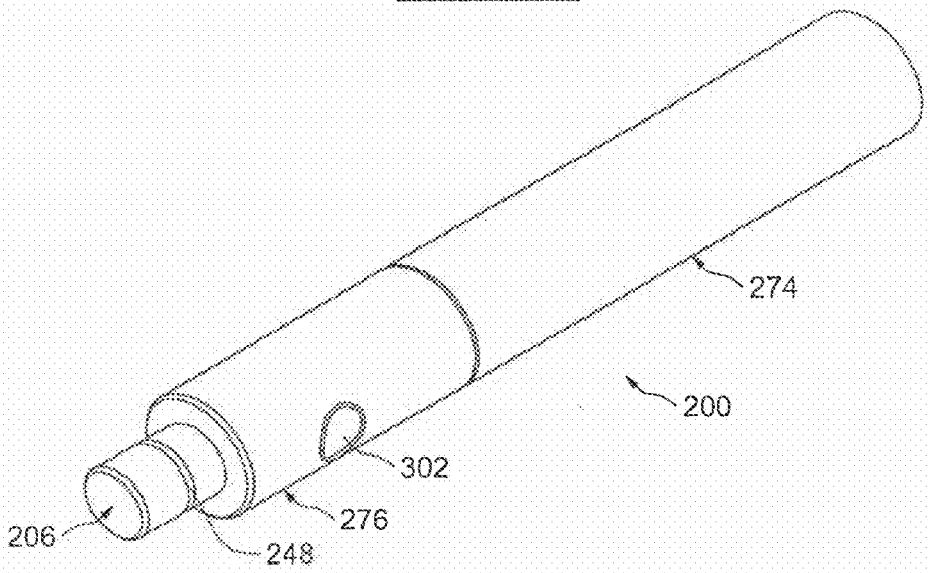

In the embodiment illustrated in FIGS. 21 to 23, in which the elements similar to the previously described embodiment bear the same references, the packaging system 202 includes a wiping member 260 mounted in the neck 210 of the container 204.

The wiping member 260 includes an axial portion 262 sealingly mounted in the neck 210 and extended, at an upper axial end, by a radial flange 264 bearing against the upper end of the neck 210 and the lower end of the cap 216 of the closure member 206. The axial portion 262 has, near the flange 264, a radial bead 266 extending towards the outside and cooperating with a groove (not referenced) of the neck 210 in order to provide axial retention of the wiping member 260 inside the neck. The root of the stem 220 is held sealed inside the axial portion 262 of the wiping member 260.

The wiping member 260 has a radial portion 268 which inwardly extends the lower end of the axial portion 262 and has an orifice (not referenced) capable of allowing the applicator 207 to pass through it. This orifice has a smaller diameter than the diameter of the applicator so as to provide greater wiping when there is considerable surplus product present on the applicator 207.

In this embodiment, the device 200 comprises mainly a protective cap 270, made in two parts, a sheath 272 for releasing the system 202, and the return means 234 for exerting an axial force on the container 204.

The protective cap 270 has a lower part 274 extended axially by an upper part 276. The lower part 274 has a body 278 extending along the axis X-X' and designed to accommodate most of the container 204. The body 278 is extended, at a lower axial end, by a bottom 280 located axially at a certain distance from the bottom 208 of the container 204. The return means 234 bear against the bottom 208 and the bottom 280.

The upper part 276 bears against the upper end of the body 278 of the lower part 274 and extends axially along its extension. The upper part 276 is fastened to the lower part 274 by any suitable means, for example by screwing, bonding or snap-fastening.

The upper part 276 has an axial portion 282 extending along the extension of the body 278 and internally defining a space for accommodating the upper end of the container 204, the sheath 272 and the closure member 206. The axial portion 282 is extended towards the inside, at an upper axial end, by a radial portion 284 flush with the upper end of the closure member 206. In the depicted example, the system 202 is entirely housed inside the protective cap 270. In this position, no part of the system 202 can be directly handled by the user. The radial portion 284 is axially extended, at a small-diameter edge, by a short axial skirt 286 extending towards the neck 210 of the container. The skirt 286 is coaxial with the axis X-X' and enables the cap 216 of the closure member 206 to be guided inside the protection device 200.

The releasing sheath 272 typically has a tubular body 290 of axis X-X' surrounding the upper end of the container 204 and the cap 216 of the closure member 206. A lower end of the body 290 is placed radially between the container 204 and the body 278 of the lower part 274, coming radially into contact against these two elements. This lower end of the body 290 typically includes radial protuberances 292 spaced apart from one another in the circumferential direction and designed to be housed inside corresponding grooves 294 provided in the body 278 of the lower part 274 so as to prevent the sheath 272 from rotating relative to the protective cap 270. The upper axial end of the body 290 is placed radially between the skirt 286 and the radial portion 282 and bears axially against the radial portion 284. The sheath 272 includes a means for releasing the system 202, of identical design to that of the previously described embodiment.

To obtain the releasing means, the sheath 272 includes, provided on the body 290, two generally C-shaped notches 294 that define an axial tongue 296 connected to the body 290 via two circumferentially opposed hinges 298. Similarly to the previously described embodiment, the tongue 296 includes, on the inside, a radial hook 300 extending towards the inside and intended to cooperate with the annular groove 248 of the cap 216 of the closure member 206 in order to retain the closure member and the packaging system 202 inside the protection device 200. The tongue 296 also includes, on the outside, a radial lug 302 able to form a means for actuating the hook 300. The lug 302 is located axially on the opposite side from the hook 300 when considering the hinges 298.

In this embodiment, the return means 234 also enhance the ability to provide good overall sealing, given that the force exerted by these means helps to maintain the axial contact between the wiping member 260 and the cap 216 of the closure member 206.

Advantageously, the upper part 276 of the protective cap 270 includes, on its outer surface, a logo, a pictogram or a region of different color from that of the rest of the cap so as to indicate to the user where pressure should be applied in order to exert a force on the lug 302 and to disconnect the packaging system 202 from the protection device 200. To this end, the protective cap 270 is made with a material having enough elasticity to allow its deformation to actuate the lug 302.

To accomplish this disconnection, the user may alternatively press on the upper surface of the closure member 206, thereby also moving the hook 300 and releasing the closure member 206 and the applicator 207.

To prevent the container 204 from being extracted from the protective cap 270 during this operation, the sheath 272 typically includes, on the inside, a radial shoulder 304 located axially between the lug 302 and the hook 300 and forming a stop surface that cooperates with the shoulder 214 of the container 204, as illustrated in FIG. 21, when the user grips the closure member 206. Thus, the container 204 remains housed inside the protective cap 270 when the closure member 206 is disconnected from the container 204 and the cap 270, for the purpose of applying the product.

The embodiment illustrated in FIGS. 24 to 27, in which the identical elements bear the same references, differs from the previously described embodiment only in that the lug 302 has a greater radial dimension so as to be able to extend through a circular opening 306 provided on the upper part 276 of the protective cap 270 so that the lug 302 is directly accessible from the outside.

Numerous modifications and variations of the present invention are possible in light of the above teachings. It is to be understood that within the scope of the appended claims, the invention may be practiced otherwise than as specifically described therein.

The invention claimed is:

1. An assembly comprising:

a package system for holding a cosmetic product;

a protection device for protecting the package system, the protection device being provided with a cap mounted on the package system so as to at least partly cover the package system and including a body having at least two notches defining a tongue integrally formed as one piece with said body and at least two opposed bridges of material forming pivot hinges in order to connect the tongue to the body, and with a releasing means for releasing the package system provided on the tongue, the releasing means including retaining means for retaining the package system relative to the cap, and actuating means for actuating the retaining means in order to disconnect the package system and the protection device, the retaining means being provided on an inner face of the tongue, the actuating means being provided on an outer face of the tongue, on the opposite side from the inner face, the releasing means being a rocker system, the protection device covering at least 90% of the package system, and covering means attached to the cap and at least partially covering the releasing means.

2. The assembly according to claim 1, wherein the covering means leave the actuating means at least partly free so as to be accessible from the outside.

3. The assembly according to claim 1, wherein the actuating means comprise a lug at least partly extending into a housing disposed on the covering means.

4. The assembly according to claim 1, wherein the actuating means are at least partly flush with the covering means.

5. The assembly according to claim 1, wherein the covering means extend at least partly into a recess disposed in the cap.

6. The assembly according to claim 5, wherein the covering means are flush with an outer surface of the cap.

7. The assembly according to claim 1, wherein the covering means comprise an envelope mounted around the cap.

8. The assembly according to claim 1, wherein the retaining means comprise a single piece integral with the actuating means.

9. The assembly according to claim 1, wherein the protection device includes a base that accommodates a container of the package system, the base being configured to be at least partly fitted inside the cap so as to define a closed chamber for the container.

10. The assembly according to claim 1, wherein the retaining means comprises snap-fastening means that cooperate with the package system or with a base of the device for accommodating the container.

11. The assembly according to claim 10, wherein the snap-fastening means comprise at least one hook that cooperates with a groove disposed in the package system or in the base.

12. The assembly according to claim 11, wherein the groove has a circular cross-section.

13. The assembly according to claim 1, at least one return means configured to disconnect the package system and the protection device when the actuating means is stressed.

14. The assembly according to claim 1, wherein the package system includes a product applicator, only the applicator being disconnected from the protection device as a result of the releasing means being activated.

15. An assembly comprising:

a package system configured to hold a product;

a protection device that protects the package system, the protection device including a cap mounted on the package system so as to at least partly cover the package system, a body including at least two notches defining a tongue integrally formed as one piece with the body and at least two bridges of material forming pivot hinges that connect the tongue to a remainder of the body and with at least one release that releases the cap from the package system, the release including the tongue, a protrusion that connects the package system to the cap, and an actuator that moves the protrusion relative to the package system, the protrusion being provided on an inner face of the tongue, the actuator being provided on an outer face of the tongue, on the opposite side from the inner face, the release being configured to pivot about an axis, the protection device covering at least 90% of the package system, and a cover attached to the cap and at least partially covering the release.

16. The assembly according to claim 15, wherein the cover comprises a material more flexible than a material comprising the package system.

17. The assembly according to claim 15, wherein the at least two opposed bridges extend from an intermediate portion of the tongue, the protrusion is disposed on a first end of the tongue, the actuator is disposed on a second end of the tongue, and the intermediate portion is disposed between the first and second ends of the tongue.

18. The assembly according to claim 1, wherein the at least two opposed bridges extend from an intermediate portion of the tongue, the retaining means is disposed on a first end of the tongue, the actuating means is disposed on a second end of the tongue, and the intermediate portion is disposed between the first and second ends of the tongue.

* * * * *